US005537196A

United States Patent [19]

Matsumoto et al.

[11] Patent Number: 5,537,196

[45] Date of Patent: Jul. 16, 1996

[54] IMAGING APPARATUS EQUIPPED WITH AUTOMATIC RECIRCULATING DOCUMENT HANDLER, AND SHEET-CIRCULATING FEEDER

[75] Inventors: Manabu Matsumoto; Yuji Okamoto, both of Nara, Japan

[73] Assignee: Sharp Kabushiki Kaisha, Osaka, Japan

[21] Appl. No.: 358,551

[22] Filed: Dec. 14, 1994

[30] Foreign Application Priority Data

Dec. 15, 1993 [JP] Japan ..... 5-315031
Dec. 27, 1993 [JP] Japan ..... 5-332035

[51] Int. Cl.[6] ..... G03G 21/00; G03G 15/23

[52] U.S. Cl. ..... 355/320; 355/313; 355/206; 355/24; 271/3.05

[58] Field of Search ..... 355/308, 309, 355/313, 318–320, 207, 209, 206, 23, 24; 271/3.1

[56] References Cited

U.S. PATENT DOCUMENTS

| | | | |
|---|---|---|---|
| 4,674,866 | 6/1987 | Tanaka | 355/23 |
| 4,786,041 | 11/1988 | Acquaviva et al. . | |
| 4,881,729 | 11/1989 | Culligan et al. | 271/3.1 |
| 4,928,151 | 5/1990 | Saeki | 271/3.1 X |
| 4,974,034 | 11/1990 | Rabb et al. | 355/319 |
| 4,980,729 | 12/1990 | Okamoto | 355/320 |
| 5,016,061 | 5/1991 | Tashiro et al. | 355/320 |
| 5,038,182 | 8/1991 | Tanimoto | 355/308 X |
| 5,091,755 | 2/1992 | Tashiro | 355/320 |
| 5,122,840 | 6/1992 | Maeyama | 355/320 |
| 5,315,360 | 5/1994 | Yamauchi et al. | 355/319 |
| 5,317,372 | 5/1994 | Nakabayashi et al. | 355/311 |

FOREIGN PATENT DOCUMENTS

| | | |
|---|---|---|
| 60-33571 | 2/1985 | Japan . |
| 60-33574 | 2/1985 | Japan . |
| 1-166056 | 6/1989 | Japan . |

*Primary Examiner*—R. L. Moses
*Attorney, Agent, or Firm*—Birch, Stewart, Kolasch & Birch

[57] ABSTRACT

Documents stacked in a document tray are fed from the lowermost sheet by a feeding belt and then by a feeding belt to a light exposure station via feeding rollers, and after light exposure are recirculated onto the uppermost sheet of the document tray by a inverted feeding roller via an ejection roller. When the documents are double-sided, they are invertedly fed in the direction of a feeding path by the feeding roller, fed to the light exposure station, and each side of the documents presented for light exposure. Here, when trouble occurs in the copying unit, the document in the feeding path is returned to the document tray while recirculative feeding of the documents remaining in the document tray is performed for automatic restoration of the documents to their originally stacked state when returned to the tray. Therefore, only the minimum necessary number of documents are fed through the inverted feeding path. Thus, restoration of the initial stacked state of the documents may be carried out automatically for shortening of the time required therefor.

11 Claims, 19 Drawing Sheets

IMAGING APPARATUS EQUIPPED WITH AUTOMATIC RECIRCULATING DOCUMENT HANDLER, AND SHEET-CIRCULATING FEEDER

BACKGROUND OF THE INVENTION

1. Field of the Invention

The present invention relates to an imaging apparatus such as a copier or printer, equipped with a document circulating feeder, which has a construction for restoration control at the document-circulating feeder end in the event of trouble occurring at the imaging apparatus end, as well as to a sheet-circulating feeder for feeding document sheets to a processing station such as a copyboard or the like.

2. Description of the Related Art

When making multiple copies from a number of documents, imaging apparatuses, for example copiers for copying images of documents, automatically feed the documents to a copying station, i.e. a light exposure station, and produce the desired number of copies. During the process, the outputted copied sheets are sorted by a sorter equipped with a plurality of trays, as means for placing the copied sheets in the serial page order of the documents.

With the aim of eliminating the need for such sorters, there have been proposed and put into practical use, as document feeders for the above-mentioned type of apparatuses, automatic recirculating document handlers of the type which produce only one copy each time the document to be copied is passed through the light exposure station, without producing all the indicated number of copies once, and then return it back to the document tray for its recirculation once again to the light exposure station. In this manner, since the circulating documents are copied one page at a time, the copied sheets are outputted after being collated in the same serial page order as the documents, and thus the circulation of the documents also serves as a sorting operation, eliminating the need for a sorter and allowing the device to be made smaller.

As a conventional measure against cases where trouble occurs while feeding the documents, such as jams at the automatic recirculating document handler (RDH) end or the copying unit end, there is provided means at the RDH end for jam recovery, i.e. for resuming copying, after the jam has been cleared, from the document at which the jam has occurred. For example, in the case of an automatic recirculating document handler such as the one disclosed in Japanese Patent Publication JP-A 1-166056 (1989), a job resuming function returns documents which have jammed at the RDH end back to the RDH in the correct order. There is disclosed a resuming function in which, when jamming of a document occurs at the RDH, the location of the fed but suspended document is determined and a paper feeding path separate from the circulative feeding path is used for restoration to resume copying in the order of the documents.

Furthermore, when the jam is not at the RDH end but at the copying unit end, the process is halted at the RDH end in the state at which the jam occurred, until the restarting of the copywork from that point after the jammed paper is removed. That is, since the jam is not at the RDH end and thus the feeding of the document has been properly performed, and the document is suspended at that position, the copying process may be resumed from the state prior to the jam after the jam has been cleared, thus completely solving the problem.

However, in cases where the feeding of the documents is halted at the RDH end due to a jam at the copying unit end or trouble other than a jam, if the document is suspended in a path in which it is inverted, curling, etc. of the document will occur and cause further jamming by the same document when the process is resumed. Particularly when circulative feeding is employed, the documents on the document tray are circulatively fed the number of times corresponding to the number of copies to be made, and thus the possibility of jamming becomes quite high. This possibility is even higher in the case of duplex copying, in which each duplex copy is made only after recirculation.

Here, it may be a solution to the trouble to feed the document, without allowing it to lie there until the solution of the trouble occurring at the copying unit end, through the RDH end (without exposing the document to light) and returned to the document tray in the original state for copying. That is, since the trouble has not occurred at the RDH end, there is absolutely no problem with the feeding of the document, and thus the document may be circulatively fed as if copying were being made normally, and returned to its original loaded state on the document tray. Then, after the trouble has been solved, normal copying may be resumed by restarting the copying process when the document in question has been fed to the light exposure station.

As a result, it is possible to eliminate trouble with document feeding, including the tendency for curling, because the document is outputted back to the document tray without lying in the feeding path.

Nevertheless, it will also be appreciated that with such a construction, a double-sided document must be returned to the document tray via a path which inverts the document, and too much time is required to restore the document to its original loaded state, and in some cases even after the trouble has been solved the document is not restored to its original loaded state. That is, in the case of either simplex or duplex copying of double-sided documents, the requirement for the front and back sides of the documents to be inverted makes it necessary for the documents to be fed repeatedly via an inverted feeding path.

Furthermore, with a large number of document pages, or double-sided documents, resumption of copying after clearing of trouble involves a much greater length of time for the document to reach the light exposure station because it must pass through an inverted feeding path. Since the feeding control requires the feeding via the inverted feeding path each time, much time is eventually spent.

SUMMARY OF THE INVENTION

A particular object of the invention is the initializing of documents without suspending the documents in the feeding path when trouble occurs at the copying unit end, and to simplify the return operation for the document and reduce the time needed to resume copying after clearing of the trouble.

It is known that automatic sheet feeders simplify the operation of processing multiple sheets, such as documents, in copiers and similar apparatuses. For example, automatic document feeders which automatically feed documents successively to a processing station carry multiple documents, which have been laid on a document tray to the copyboard of the copier, starting with the lowermost or uppermost sheet, and after completion of light exposure by the copier the document on the copyboard is outputted to a prescribed location while the next document on the document tray is fed to the copyboard. Sheet-circulating feeders, which are a type of automatic sheet feeder, are provided with a circulative feeding path from the bottom of a document tray on which sheets such as documents are stacked rest, to the top of the document tray, via a processing station. Thus, by circulating the sheets in a loop pattern via the processing station, it is possible to use the same station for stacking document sheets before and after processing to make a smaller sized apparatus, while also returning the processed sheets to the top of the document tray with continuous feeding of the next sheet from the document tray, thus facilitating the handling of multiple sheets. Such circulating feeder-type automatic recirculating document handlers used in copiers and the like are commonly called RDHs, and they include UDHs, which have a document supplier for feeding documents one page at a time to the copyboard of the copier.

Nevertheless, when multiple sheets stacked on a document tray are in the process of being processed with a conventional sheet-circulating feeder, sheets which have already been processed are placed on the document tray on top of sheets which are yet to be processed, and therefore when jamming of a sheet occurs in the circulative feeding path, a procedure is necessary to return all of the sheets, including the sheet removed from the circulative feeding path, to the proper stacking order; since with conventional sheet-circulating feeders this procedure must be carried out manually by the operator, they have been problematic in terms of the bother and time required for recovery after jamming.

In particular, since sheet-circulating feeders have a relatively long feeding path and serially feed multiple sheets at prescribed intervals, it results that a number of sheets are suspended in the circulative feeding path at one time, rendering quite complicated the procedure for restoring the original stacking order on the document tray. Furthermore, when both sides of the sheets stacked on the document tray are being processed, not only must the stacking order of the multiple sheets be restored, but each individual sheet must also be restored to its proper orientation, which further complicates the recovery operation after a jam.

It is another object of the invention to provide a sheet-circulating feeder which, in cases of jamming of sheets in the circulative feeding path, allows part of the recovery operation to be carried out automatically by the apparatus, to thus simplify manual processing of the sheets by the operator and thereby alleviate the burden of the operator during the recovery operation after a jam.

The means for restoring a document to its initial state according to the invention has the following construction.

The imaging apparatus according to the invention is provided with an automatic recirculating document handler comprising a circulative feeding path which feeds documents stored in a document tray to a light exposure station with one side facing either upward or downward and, after the documents have been read, feeds the documents back to the document tray with the above-mentioned one side facing in the same upward or downward direction, and an inverted feeding path which invertedly feeds the documents to expose the opposite sides of the documents to light at the above-mentioned light exposure station, positioned in the circulative feeding path, for forming an image corresponding to the document on paper which is appropriately fed when the circulating documents are exposed to light at the light exposure station, and is characterized by further comprising:

a cycle detecting sensor for detecting one cycle of all the documents stored in the document tray; and initializing feed control means for feeding documents in the circulation path of the automatic recirculating document handler back to the document tray in the event of trouble occurring in the imaging apparatus, while circulatively feeding the documents in the document tray until one cycle has been detected by the cycle detecting sensor;

wherein the initializing feed control means, depending on the copy mode prior to the occurrence of trouble, selects the inverted feeding path for feeding a document being circulatively fed which is to be returned to the document tray, only when the document which is fed for restoration to the initial held state should be inverted before being returned to the document tray, and otherwise selects the circulative feeding path.

The copy mode is a mode for simplex copying of double-sided documents, or for duplex copying of double-sided documents, and in either mode it is determined whether or not the document is returned via the inverted feeding path.

The control of resuming copying once the document initialized according to the invention has been returned to its state prior to the trouble is achieved by the following means.

The imaging apparatus according to the invention which is provided with an automatic recirculating document handler comprising a circulative feeding path which feeds documents stored in a document tray to a light exposure station with one side facing either upward or downward and, after the documents have been read, feeds the documents back to the document tray with the one side facing in the same upward or downward direction, and an inverted feeding path which invertedly feeds the documents to expose the opposite sides of the documents to light at the light exposure station, positioned in the circulative feeding path, and for forming an image corresponding to the document on paper which is appropriately fed when the circulating documents are exposed to light at the light exposure station, and is further characterized by comprising:

a cycle detecting sensor for detecting one cycle of all the documents stored in the document tray; and initializing feed control means for feeding documents in the circulation path of the above-mentioned automatic recirculating document handler back to the document tray in the event of trouble occurring in the above-mentioned imaging apparatus, while circulatively feeding the documents in the document tray until one cycle has been detected by the above-mentioned cycle detecting sensor;

storage means for storing the copy mode at the time of occurrence of trouble in the imaging apparatus and the state of copying prior to the trouble; and copy resumption control means for, upon clearing of the trouble of the imaging apparatus, feeding through a document in the document tray which has been initialized, after determining, based on the stored information of the storage means, whether or not the document being processed at the time of the trouble should be passed through the inverted feeding path to be exposed to light at the light exposure station;

wherein the initializing feed control means, depending on the copy mode prior to the occurrence of trouble, selects the inverted feeding path for feeding the document being circulatively fed which is to be returned to the document tray, only when the document which is fed for restoration to the initial held state should be inverted when returned to the document tray, and at all other times selects the circulative feeding path.

The invention is further characterized in that a sheet-circulating feeder provided with a circulative feeding path from the bottom of the document tray via the processing station to the top of the document tray, comprises first feedthrough means for circulating sheets on top of the document tray through a circulative feeding path during the restoration operation after sheet jams, to restore the original order of the multiple sheets on the document tray to their state prior to the beginning of their processing;

second feedthrough means for circulating processed sheets through the circulative feeding path after completion of their circulation by the first feedthrough means, without processing them at the processing station; and processing feeding means for processing the unprocessed sheets after completion of their feedthrough by the second feedthrough means and feeding them through the circulative feeding path.

The invention is still further characterized by comprising cycle detecting means for detecting the completion of one cycle of the multiple sheets stacked in the document tray through the circulative feeding means and processed sheet counting means for counting the number of sheets which have been processed at the processing station, wherein the first feedthrough means is means for circulating sheets on the document tray from the next page until the cycle detecting means detects the completion of one cycle of all the sheets counting those processed before the occurrence of the jam without processing the sheets at the processing station, and the second feedthrough means is means for circulating only the number of the sheets in the tray counted by the processed sheet counting means after completion of circulation of the sheets by the first feedthrough means, without processing the sheets in the document tray at the processing station.

The invention is still further characterized in that the sheet-circulating feeder provided with a circulative feeding path from the bottom of a document tray to the top of the document tray, via an inverting feeder which inverts the front and back ends of the sheets and a processing station which processes the sheets, comprises first feedthrough means for circulating the sheets in the document tray through the circulative feeding path during the restoration operation after a sheet jam to restore the stacking order of the multiple sheets in the document tray or to restore the stacking order and up/down orientation of the multiple sheets in the document tray to their state prior to initiation of the processing;

second feedthrough means for circulating the processed sheets through the circulative feeding path after completion of their circulation by the first feedthrough means, without processing the sheets at the processing station; and processing feeding means for processing the unprocessed sheets at the processing station after completion of the feedthrough by the second feedthrough means and feeding them through the circulative feeding path.

The invention is still further characterized by comprising cycle detecting means for detecting completion of one cycle of the multiple sheets stacked in the document tray, counting those processed prior to the occurrence of the trouble, through the circulative feeding means and processed sheet counting means for counting the number of sheets which have been processed at the processing station, wherein the first feedthrough means is means for circulating the sheets on the document tray without processing the sheets in the document tray at the processing station, until the cycle detecting means detects the completion of one cycle of all the sheets counting those processed before the occurrence of the jam, the second feedthrough means is means for circulating only the number of sheets on the tray counted by the processed sheet counting means after completion of circulation of the sheets by the first feed through means, without inverting the front and back ends of the sheets in the document tray at the inverting feeder or processing them at the processing station, and the processing feeding means is means for processing the unprocessed sheets at the processing station without inverting the front and back ends at the inverting feeder, and feeding the sheets through the circulative feeding path, from the processing by the second feedthrough means until one additional cycle of all the sheets counting those circulated by the second feedthrough means is detected.

The invention is still further characterized by comprising cycle detecting means for detecting one cycle of all of the multiple sheets stacked in the document tray through the circulative feeding means and processed sheet counting means for counting the number of sheets which have been processed at the processing station, wherein the first feedthrough means is means for circulating the sheets on the document tray without processing the sheets in the document tray at the processing station, until the cycle detecting means detects two cycles of all the sheets counting those processed before the occurrence of the jam, the second feedthrough means is means for circulating only the number of the sheets on the tray counted by the processed sheet counting means after completion of circulation of the sheets by the first feedthrough means, without processing the sheets at the processing station, and the processing feeding means is means for processing the unprocessed sheets at the processing station and feeding the sheets through the circulative feeding path, until the cycle detection means detects one additional cycle of all the sheets counting those circulated by the second feedthrough means.

The invention is still further characterized by comprising message displaying means for displaying a message which prompts confirmation of the stacking state of the sheets in the document tray after the sheets have been circulated by the first feedthrough means, and delaying means for delaying the initiation of engagement of the second feedthrough means until input of the confirmation.

The invention is still further characterized in that the message displaying means displays its message upon detection of the prescribed number of cycles of sheets by the cycle detecting means during the restoration operation after the occurrence of a jam.

According to the invention, the automatic document feeder with a circulative feeding path is characterized in that, when trouble occurs at the copying unit end, documents in the automatic document feeder are circulated via the feeding path, and while state of the stacked documents prior to the occurrence of the trouble is restored, they are fed through an inverted feeding path only when the documents should be inverted. Thus, by this construction for the initializing of the circulatively fed documents, though the operation of the imaging apparatus according to the invention is halted when trouble occurs at the imaging apparatus end, the documents continue to be fed by the automatic recirculating document feeder.

In this case, when the copying mode is set for duplex copying of double-sided documents, in cases where copying is started from the back sides of the documents, they are returned to the document tray by the document circulative feeding path involving an inverted feeding path, and thus the documents are held with their fronts and backs inverted. Here, when trouble occurs during copying, the documents in the circulative feeding path are fed inverted and then held in the tray. Also, so long as the cycle detecting sensor has not detected one cycle, the documents left in the document tray continue to be fed without processing through the circulative feeding path without passing through the inverted feeding path, being then returned to the document tray, until detection is made by the cycle detecting sensor. Thus, on the tray are held both the documents whose backside copying has been completed and the documents which had been left in the circulative feeding path as a result of the trouble and whose front and back sides have been inverted. As a result, the cycle detecting sensor is reengaged to continue one-cycle detection, while the documents are circulated. During this circulation, only the documents whose front and back sides have been inverted are inverted again via the inverted feeding path before being returned to the document tray. However, non-inverted documents are returned without passing through the inverted feeding path. Thus, the initializing is complete upon the detection of one cycle by the cycle detecting sensor. In this case, since not all of the documents are forced to pass through the inverted feeding route, the circulative feeding time may be shortened.

By controlling the document feeding in the manner described above, the document feedthrough time until copy resumption may be greatly shortened even when trouble occurs at the copying unit end, whether it be in the mode for duplex copying from double-sided sheets or simplex copying from double-sided sheets. In particular, since the documents are returned to the document tray, quality reduction of the documents themselves is prevented, thus helping to eliminate a cause of further jams during subsequent document feeding, to allow efficient and effective copywork.

On the other hand, when, in the case of duplex copying from double-sided documents, the documents are being copied from the front after having been copied from the back, they are restored to their initial state. This is because the copying has finished the first cycle and thus the documents have passed through the inverted feeding path two times. As a result, when trouble occurs in the imaging apparatus in such a case, the documents in the circulative feeding path are returned to the document tray without inversion, in order to be restored to their initial state. However, the remaining documents in the document tray which have not completed one cycle as detected by the cycle detecting sensor are inverted and held. Here, the feeding of the documents in the document tray is carried out via the inverted feeding path and then returned to the document tray, to arrange their fronts and backs as according to their initial state. This means that the completion of the feeding control is indicated upon detection by the cycle detecting sensor, and the documents are restored to their initial state in the document tray.

In addition, in the case of simplex copying from double-sided documents, the documents are returned to the document tray after having been copied first from the back and then from the front. In this case, since they pass through the inverted feeding path twice, the documents are returned with the faces in the same direction. Here, the initialization of the documents in the event of trouble at the imaging apparatus during this copying is carried out at the automatic recirculating document handler. If the documents are being copied from the back in the document circulative feeding path, then the documents are returned to the document tray via the inverted feeding path. However, when the documents are being copied from the front, they are returned directly to the document tray without passing through the inverted feeding path. Also, until the cycle detecting sensor detects one cycle, documents still remaining in the document tray which are yet to be copied are also circulatively fed. This circulative feeding returns the documents back to the tray without passing through the inverted feeding path. In this manner, the documents passing through the inverted feeding path are limited to those which are in the document circulative feeding path, and only those being copied either from the back or front, and thus the feeding time for initialization is shortened.

Moreover, in cases where, after initialization of the documents has been carried out in the manner described above, the copying is resumed after returning the documents to their state at the time of the occurrence of the trouble after the trouble has been resolved, the copying mode and copy state at the time of the trouble are recorded. Based on the recorded information, feed control of the documents is carried out without light exposure, while the documents in the tray are returned to their state at the time of the occurrence of the trouble. Especially in the case of duplex copying from double-sided documents, if a document is being copied from the back it is returned to the tray via the inverted feeding path without light exposure, and this is continued until the document in question reaches the light exposure station, where copying of the document is initiated at the time it reaches the light exposure station. At that time, if the copying is from the front, the documents are fed serially without passing through the inverted feeding path to be returned to the tray, while only the document of interest whose copying has not been completed as a result of the trouble, undergoes copying which restarts upon its reaching the light exposure station.

Furthermore, in the mode for simplex copying from double-sided documents, documents are fed via the inverted feeding path and returned to the tray, while the document in question is fed to the light exposure station via the inverted feeding path to be copied either from the front or the back.

Even when copying restarts in the manner described above, since only a minimum number of documents are fed through the inverted feeding path during the feeding of the initialized documents, the time required for resumption of copying after the trouble has been cleared is shortened. Also, according to the invention, since the number of the documents fed for their initialization and for initiation of their copying after initialization is drastically reduced, the degree of damage incurred on the documents may be minimized, which is very helpful from the viewpoint of preventing quality loss of the documents and provides efficient and effective copywork.

In other words, since the number of time the documents are reinverted in the light exposure mode and feeding mode during the initial handling of the documents is kept to an absolute minimum, even when trouble occurs in the copying unit, damage to the documents by feed through may be minimized, while the automatic initialization handling reduces the work of the operator and provides efficient copywork.

Furthermore, according to the invention, the automatic sheet feeder with a circulative feeding path from the bottom of the document tray through the processing station to the top of the document tray is characterized by comprising first feedthrough means which restores the stacking order of the sheets in the document tray to their state prior to processing and second feedthrough means which circulates the processed sheets without reprocessing them. Thus, when sheet jamming occurs in the circulative feeding path, the proper stacked state of the documents may be restored by simply placing in the document tray the sheets removed from the feeding path, regardless of the orientation of the sheets. Because the initial stacked state of the documents is automatically restored, the time required therefor is shortened.

According to the invention, when the operator stacks the sheets on the uppermost sheet in the tray which were suspended in the circulative feeding path at the time of occurrence of a jam, in their stacking order prior to the beginning of processing, the first feedthrough means restores all of the sheets in the document tray to their stacking order prior to the beginning of processing, while the second feedthrough means feeds only the processed sheets through the circulative feeding path without processing them, and returns them to the document tray. After this, the means processes the unprocessed sheets and feeds them through the circulative feeding path. Consequently, the replacing of the sheets which were suspended in the circulative feeding path into the document tray in the desired state is the only manual action that the operator must perform, and all the other handling for restoring the operation after a jam is carried out automatically.

According to the invention, one cycle of all of the multiple sheets stacked in the document tray through the circulative feeding path is detected by the cycle detecting means. In addition, the number of sheets which have completed processing at the processing station are detected by the processed sheet counting means. When a jam occurs when a sheet is in the circulative feeding path, during the restoration operation the sheets in the document tray are fed through the circulative feeding path until the cycle detecting means detects one cycle of all the sheets counting those processed before the occurrence of the jam. Consequently, when the operator stacks the sheets on the uppermost sheet in the tray which were suspended in the circulative feeding path at the time of the occurrence of the jam back to their stacking order prior to the beginning of processing, the multiple sheets in the document tray are restored to their initial stacking order by the first feed through means. At this point, the second feedthrough means then feeds through the circulative feeding path only the number of sheets in the document tray corresponding to the number counted by the processed sheet counting means. That is, the processed sheets are fed through and returned back on top of the unprocessed sheets on the document tray, and the sheets fed through the circulative feeding path thereafter by the processing feeding means are the unprocessed sheets.

According to the invention, in the copy mode for single-sided documents with an RDH, the restoration operation is automatically carried out when the operator returns the sheets which have been suspended in the feeding path back to the document tray in the same state as at the time the documents were originally stacked, providing the advantage of allowing very easy performance of the proper copywork.

According to the invention, when the operator, in the event of a jam, places sheets which have been suspended in the circulative feeding path in the same orientation as the uppermost sheet in the tray, and stacks them on the uppermost sheet in the document tray in the same stacking order as before the initiation of the processing, all of the sheets on the document tray are restored to the same order and orientation as before the initiation of the processing, while only the processed sheets are fed through the circulative feeding path without being processed and the unprocessed sheets are processed while being fed through the circulative feeding path. Consequently, even in cases where an inverted feeding path for inverting the tops and bottoms of the sheets is included in the circulative feeding path for processing of both sides of the sheets, the only manual operation by the operator is that of returning the sheets which have been suspended in the circulative feeding path back to the document tray in the desired state, while all the other handling for restoring the operation after a jam is carried out automatically.

According to the invention, during the restoration operation after the occurrence of a jam, the sheets are fed through the inverted feeding path while inverting their tops and bottoms, until the cycle detecting means detects one cycle of all the sheets counting those processed before the occurrence of the jam. Consequently, when the operator returns the sheets which were in the circulative feeding path at the time of the occurrence of the jam back onto the uppermost sheet in the tray in the desired state, upon completion of handling by the first feedthrough means, all of the sheets are placed in the document tray with their simplex or duplex processing completed. At this point, the second feedthrough means then circulates through the circulative feeding path only the number of sheets in the document tray corresponding to the number counted by the processed sheet counting means, without inverting their tops and bottoms or processing them, and the sheets whose processing has actually been completed are placed over the unprocessed sheets. The processing feeding means guides the unprocessed sheets in order through the circulative feeding path, processes them at the processing station and returns them onto the document tray. Consequently, once the handling by the processing feeding means has been completed, the sheets whose simplex or duplex processing has actually been completed become situated in the document tray in their same stacking order as prior to the beginning of processing.

According to the invention, during the restoration operation after the occurrence of a jam, the sheets are fed through the inverted feeding path while inverting their tops and bottoms, until the cycle detecting means detects two cycles of all the sheets counting those processed before the occurrence of the jam. Consequently, when the operator returns the sheets which were in the circulative feeding path at the time of the occurrence of the jam back onto the uppermost sheet in the tray in the desired state, upon completion of handling by the first feedthrough means, all of the sheets are placed in the document tray in the same stacking order as prior to the beginning of processing. At this point, the second feedthrough means then circulates through the circulative feeding path only the number of sheets in the document tray corresponding to the number counted by the processed sheet counting means, without processing them, and the sheets whose processing has actually been completed are inverted and placed over the unprocessed sheets. The processing feeding means guides the unprocessed sheets in order through the circulative feeding path, processes them at the processing station and returns them onto the document tray. Consequently, once the handling by the processing feeding means has been completed, all of the sheets on which the same simplex or duplex processing has actually been completed become situated in the document tray in their same stacking order as prior to the beginning of processing.

According to the invention, in the copy mode for double-sided documents with an RDH, in the event of a jam of the documents, the operator simply returns them to the document tray in the same state as the documents on top of the tray, without having to perform any complicated handling of the documents, thus providing the advantage of allowing very easy completion of the desired copywork.

According to the invention, when the circulation of the sheets by the first feedthrough has been completed, a message is displayed prompting the operator to confirm the stacking condition of the sheets. The operator makes confirmation as necessary, and upon input to indicate that the stacking condition is proper, handling is carried out from the second feedthrough means onward. Consequently, the operator is able to check whether or not the multiple sheets are placed in the document tray in the proper order, for accurate handling thereafter.

According to the invention, a message is displayed, upon completion of feedthrough of the documents which were in the document tray at the time of the jam, prompting the operator to check whether or not the documents are in their original stacked state, and thus even if the operator makes an error in handling the documents which were in the document feeding path at the time of the occurrence of the jam, mishandling of the documents may be prevented before it occurs.

According to the invention, the completion of the circulation of the sheets by the first feedthrough means is indicated by the detection of the prescribed number of cycles of all the sheets by the cycle detecting means. Consequently, it is possible to accurately judge the completion of operation of the first feedthrough means based on the detection signal of the cycle detecting means.

In other words, an advantage of the invention is that a message is displayed prompting the operator to check whether the documents are in their initial state when the sensor which detects one cycle of the documents is switched on so that checking of the stacked state may be carried out at the proper time, and the proper copywork may be quickly and accurately performed.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
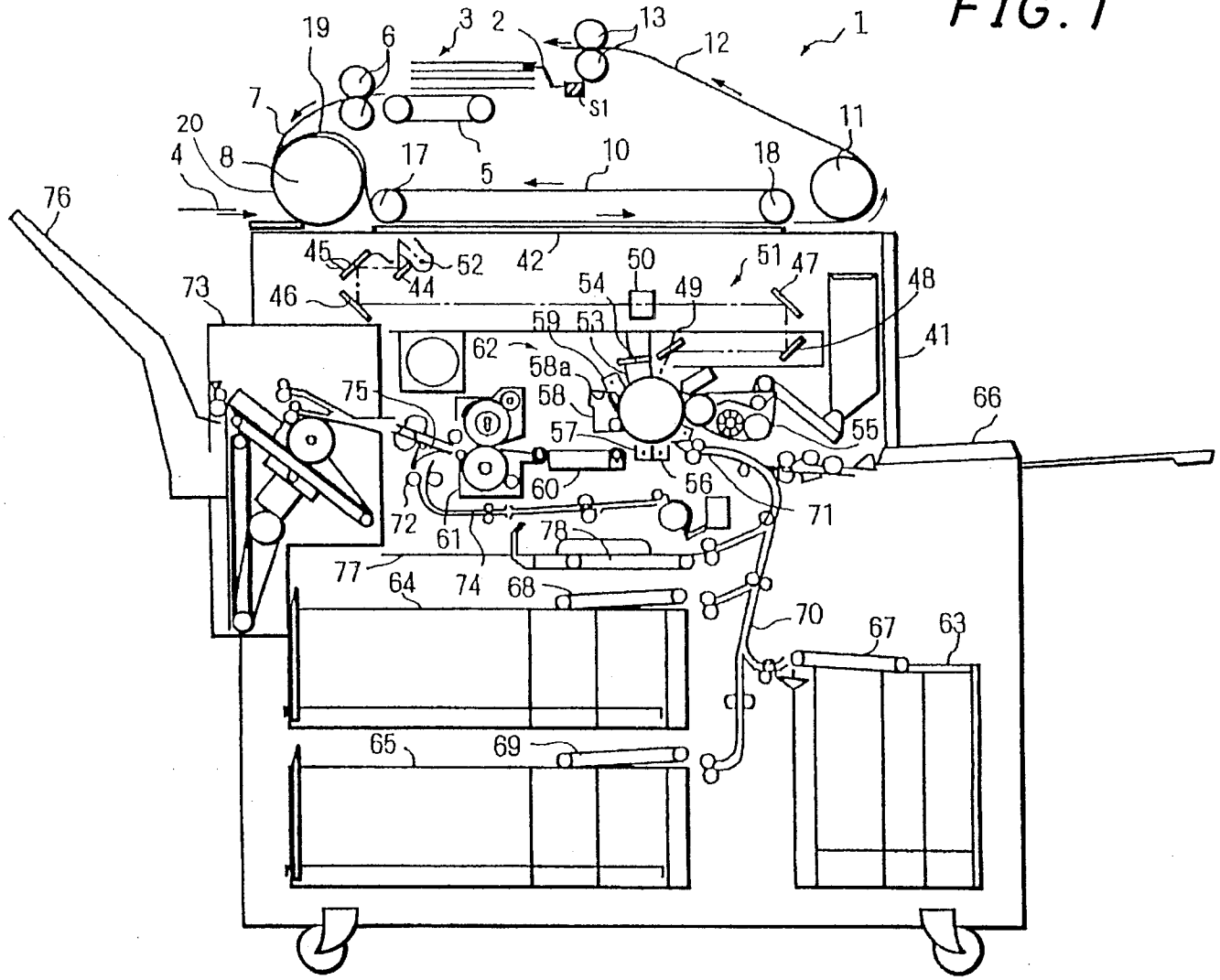
FIG. 1 shows the construction of an embodiment of a copying unit with an RDH according to the invention.

Now referring to the drawings, preferred embodiments of the invention are described below.

FIG. 1 shows an embodiment of the construction of a copier with an RDH 1 which is a sheet document-circulating feeder, according to the present invention. A light scanning copyboard 42 is provided on top of the copying unit 41 which is furnished internally with the copy processor 62 described below, and the RDH 1 is mounted on top of the copyboard 42. The copyboard 42 is set at an area where the documents are scanned with light, and it is made of transparent glass. The RDH 1, which is the document feeder, carries documents in a document stacking tray (document tray 3) to a copyboard 2, and then circulatively sends them back to the document stacking tray. Also, when the documents are automatically fed they are kept at the position shown in the figure, while in cases where documents in the form of books, etc. are manually placed on the copyboard, the entire RDH 1 is mounted in a liftable manner to accept the documents.

Below the copyboard 2 there is situated an optical system 51 comprising mirrors 44–49 and a zoom lens 50. The optical system 51 irradiates light rays from a copying lamp 52 onto the documents for light scanning, while light reflected from the documents is taken and guided to a photoconductor drum 53 situated below the optical system 51.

The photoconductor drum 53 is driven by a main motor (not shown). Around the photoconductor drum 53 there are situated a charger 54, a developing device 55, a copying device 56, a stripper 57, a cleaning device 58, and a static eliminator 59, etc. Also, near the stripper 57 there are provided a feeder 60 and a fixer 61. The cleaning device 58 is equipped with a cleaning blade 58a which is in contact with the photoconductor drum 53 to wipe off excess toner.

Below the developing device 55 there is situated a paper supply tray 63, and paper supply trays 64 and 65 are also arranged adjacent to the paper supply tray 63. Also, a hand-fed paper supply station 66 is arranged on the side of the developing device 65 of the copying unit 41. The paper supply trays 63–65 are capable of holding multiple sheets of paper to be supplied for copying, and the paper is successively supplied from the uppermost sheet by paper supply belts 67–69 provided on the paper outlet sides separately. Also, the hand-fed paper supply station 66 allows insertion of paper of differing sizes, one sheet at a time.

The copy processor 62 is constructed with these parts including the photoconductor drum 53, and the copy processor 62 produces, as a toner image, an electrostatic latent image formed on the photoconductor drum 53 by light from the optical system, and copies the toner image onto the paper supplied from the supply trays 63–65, etc. The copy processor 62 feeds the paper stripped by the stripper 57 to the fixer 61 by the feeder 60, and the toner image is fixed onto the paper at the fixer 61 by heat and pressure.

A feeding path 70 is provided from the space formed between the paper supply tray 63 and the paper supply trays 64, 65 upward to the area near the photoconductor drum 53. The feeding path 70 guides the paper fed from the paper supply trays 63–65, the hand-fed supply station 66 and an intermediate tray 77 described later, to the photoconductor drum 53. A resistance roller 71 which supplies paper at a prescribed timing is provided at the opening end of the feeding path 70 near the copying device 56.

A feeding switcher 72 is provided at the paper exiting end of the fixer 61. The feeding switcher 72 is provided with a gate flapper 75 which switches the path of the paper to guide the paper to the feeding path 73 in the case of simplex copying, and to the feeding path 74 in the case of duplex copying. The feeding path 73 ejects the paper to an ejection tray 76, and if necessary, also functions as a finisher, which is an apparatus for after-processing, such as stapling, etc., of the sheets. The paper supply tray 76 has a construction capable of being driven up and down to receive multiple sheets of paper stapled by the feeding path 73.

The feeding path 74 runs from the feeding switcher 72, passing on the bottom of the fixer 61 and the feeder 60, stretching under the photoconductor drum 53, and guiding the paper to an intermediate tray 77. The intermediate tray 77 is provided under the location of the fixer 60, and it receives simplex-copied paper fed via the feeding path 74. The intermediate tray 77 supplies paper whose fronts and backs have been inverted by a feeding belt 78 provided on the paper exiting end.

Figure 2:
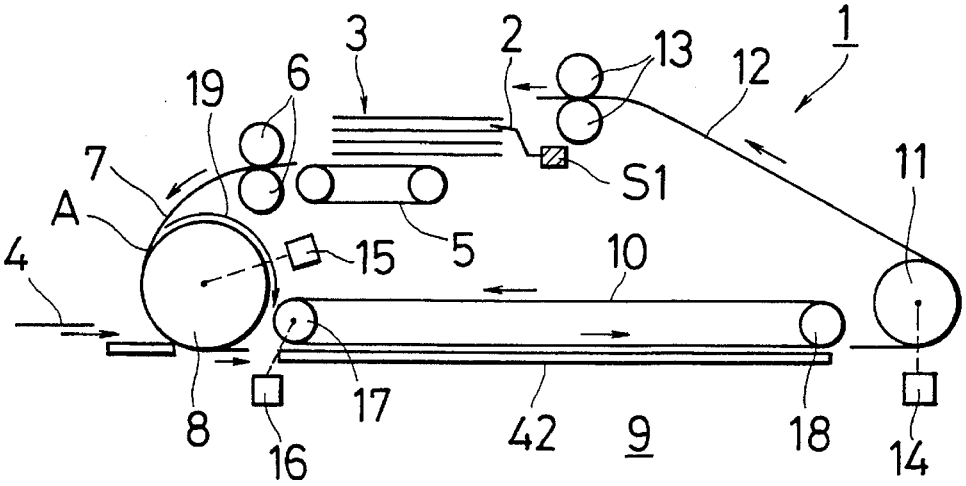
FIG. 2 shows the construction of an RDH according to the invention.

FIG. 2 is a side sectional view of an RDH 1 according to an embodiment of the invention. The RDH 1 is a device capable of switching between a recirculating document handling mode (abbreviated as RDH mode) for feeding from the bottom and stacking on the top, and separate document feeding mode (abbreviated as SDF mode), which is set for one page at a time by hand.

The documents are held in the document tray (document stacking tray) 3 so that the first page is facing upward, and page feeding begins from the lowermost document. In the case of single-sided documents, each document D stacked in a document stacker 4 is fed by a feeding roller 8, after which it is returned to the document tray 3 via the same path as in the RDH mode.

The feeding roller 8 performs the role of document feeding in the RDH mode, and in the SDF mode it performs the role of document insertion, and thus has two functions as a roller.

A feeding belt 10 is girdled around and spans across a driving roller 17 rotated by a motor 16 and a driving roller 18 opposing the driving roller 17, and it rotates in the direction of the arrow being driven by the motor 16. The feeding belt 10 is provided with a plurality of through-holes, the suction hole of an air suction duct, not shown, which is provided in the inside of the girdled feeding belt 10, i.e. in the space defined by the feeding belt 10 between both of the rollers 17 and 18, contacts the top of the inner circumference of the lower feeding belt 10. Thus, while it runs the feeding belt 10 is subjected to the sucking action of the air suction duct, and the documents D are adhered to the feeding belt 10 so as not to slide when being fed to the feeding roller 11 end.

In the case of duplex mode for copying images from both sides of double-sided documents stacked in the document tray 3, once the tail end of a document D taken into the feeding path 7 by the roller 6 reaches point A, the top and bottom of the document are inverted passing through the inverted feeding route 19 by the reverse rotation of the feeding roller 8, and it is fed by the feeding belt 10 so that the back is facing the copyboard 42. Thereafter, the document is returned to the document tray 3 via the same route as in the case of RDH mode for single-sided documents, as described above. That is, the documents which have completed one cycle are returned to the document tray 3 with their fronts and backs reversed.

The sheets which have completed the copying process of their back sides are stacked in the intermediate tray 77, and are supplied to the copy processor from the intermediate tray 77 for copying of the front image of the same documents which have been fed with their fronts and backs inverted during the second circulation.

Consequently, the stacked bundle of the documents is circulated twice, and during the first circulation all of the documents are copied only from the back sides onto paper supplied from the supply tray, and the sheets are stacked in a duplex tray 77 inside the copying unit 1, while during the second circulation the sheets stacked in the duplex tray 77 inside the copying unit 1 are supplied, and copying of only the front sides of the documents is performed onto the front sides of the sheets. Thus, the sheets copied on both sides are ejected into an ejection tray 76 to complete the duplex copying of a portion of the double-sided documents.

A sensor S1 provided in the document tray 3 is a recycle sensor which detects the completion of one cycle of all of the multiple documents D stacked in the document tray 3.

When the final document is supplied, the cycle of the documents is detected by the actuator of the recycle sensor S1. The sensor S1 is provided with an actuator 2 which is in contact with the top surface of the document initially located on top of the documents stacked in the document tray 3. This actuator 2 is lowered along with the gradual downward movement of the same document located on the top initially, due to the progressive feeding of the documents from the bottom, and when no documents remain at the bottom, the sensor S1 registers the completion of one cycle of processing of all the documents stacked in the document tray. At this time, the actuator 2 of the sensor S1 moves to once again contact the top surface of the top document.

By using this sensor S1 and a counter, it is possible to know the number of document sheets supplied for one cycle, and thus detection of misfeeding of plural documents at one time becomes possible. The front/back orientation of the documents above and below S1 is the same whether in the case of single-sided documents or that of simplex copying of double-sided documents described later, but in the case of duplex copying of double-sided documents, the front/back orientation of the documents above and below S1 is reversed. Also, when necessary the actuator for S1 is engaged when the final document is returned onto the top document D in the document tray, to be located on that document.

Furthermore, in the case of simplex copying of double-sided documents, when the tail end of a document taken up by a roller 6 reaches point A, it is reversed again while passing through a path 19 by the reverse rotation of the roller 8, and it is taken up onto a reading station 9 for exposure of its back side to light. After this side is exposed to light, the document is again inverted passing from the reading station 9 through the paths 20, 19 by the reverse rotation of the roller 8 and the feeding belt 10, and is again taken up onto the reading station 9 with the front side of the document as the side of light exposure. Also, after this side is exposed to light, the document is returned to the document tray 3 by the same operation as for single-sided documents described above. Thus, the documents in the document tray 3 which have been circulated are returned to their initial stacked state.

Figure 3:
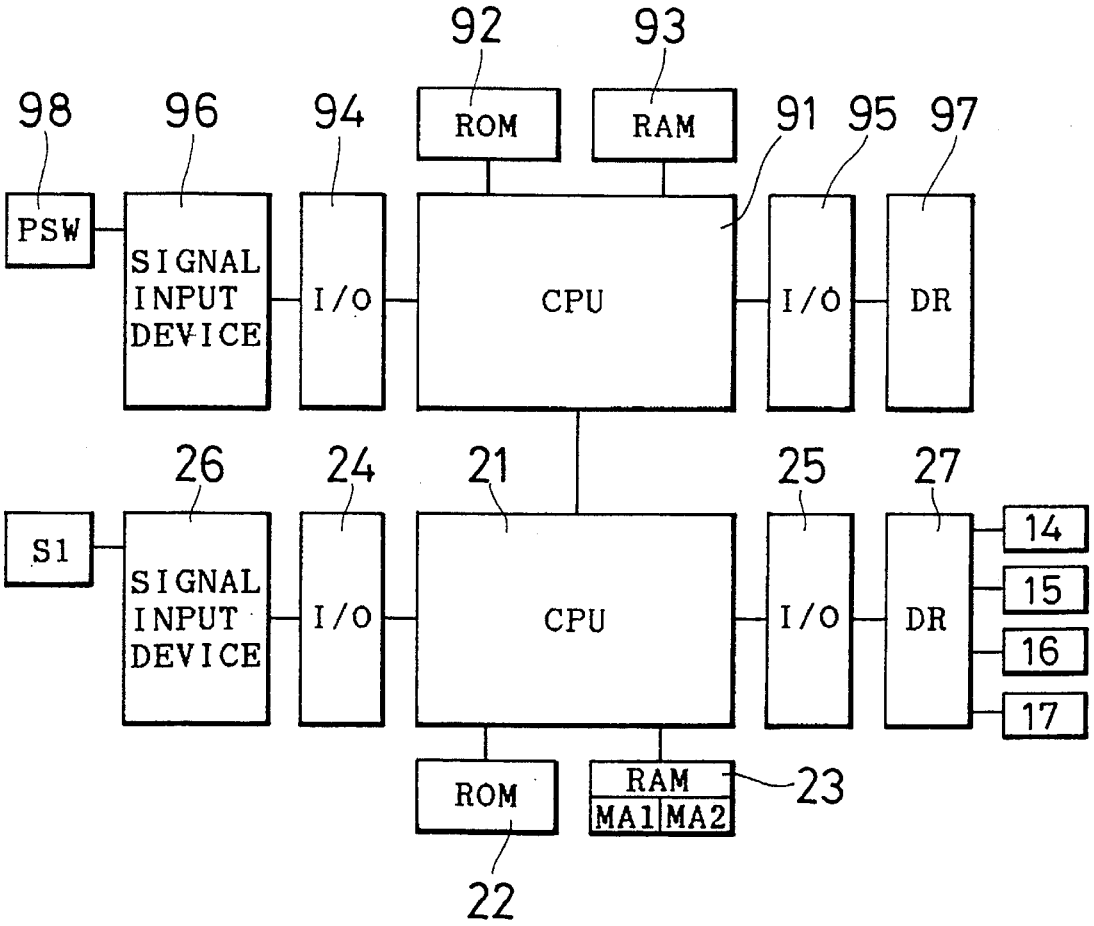
FIG. 3 is a block diagram of the controllers of the same copying unit end of the same RDH.

FIG. 3 is a block diagram of the controllers of the RDH and copying unit. A CPU 91 forming the controller of the copying unit 41 carries out its control based on a program stored in a ROM 92. A RAM 93 is organized into a buffer memory and flags necessary for copy control, and other calculation areas. A signal input device 96 is connected to the CPU 91 via an interface 94. The signal input device 96 is connected with switches, such as a print switch 98, and a sensor which is not shown, and key switch operating data and sensor detection data are input into the CPU 91 via the interface 94.

In other words, in the copying unit 41, the detection signal of the location of the fed paper, the signal of the detected location of the photoconductor, and other signals are sent to the microcomputer (CPU) 91 via the interface circuit 94, while in the automatic recirculating document handler 1 the detection signal of the location of the fed documents, and other signals, are also transferred to the microcomputer (CPU) 91.

In the case of the RDH mode, the multiple documents D stacked in the document tray are serially fed out from the lowermost one D by a delivery belt 5 constructed directly under the document tray 3. Each of these documents D passes between a pair of delivery rollers 6 constructed downstream from the delivery belt 5 and reaches the processing station 9 consisting of a copyboard 42, via the feeding path by the action of the feeding roller 8. At the processing station, the document D is fed onto the copyboard 42 by the feeding belt 10, and is subjected during this time to light exposure scanning by a copying lamp 52 of the optical system 51. Once the light exposure scanning of each document D is complete, it is fed by the feeding belt 10 and inverted via a feeding roller 11 which is driven by a motor 14, and is then returned to the top of the documents D on the document tray 3 via a return path 12 and a pair of return rollers 13.

The feeding roller 8 is situated under the feeding path 7 provided downstream from the delivery roller 6, and it is rotated by a motor 15 directly connected at the axis, for inverted feeding of the documents D to the copyboard 42. At a location on the opposite side of the processing station 9, that is, at a location sandwiching the feeding roller 8 at the side opposite to the copyboard 42, there is provided a document stacker 4 which allows manual feeding of the documents D one page at a time. This document stacker 4 is used in the sheet-by-sheet manual document feeding mode, and a document sheet D placed on the document stacker 4 is fed by the feeding roller 8, after which it is handled in the same manner as in the circulative document feeding mode to return to the tray 3.

In addition, a driver array 97 is connected to the CPU 91 via the interface 95. To this driver array 97 there are connected various parts such as motors, solenoids, and LEDs, etc. specifically, a driving motor 15 for the feeding roller 8, and a driving motor 16 for the feeding belt 10, etc. The CPU 91 outputs driving data to the driver array via the interface 95. The driver array 97 drives the motors, etc. based on this driving data. The CPU 91 is connected to a CPU 21 composing the controller of the RDH 1. Consequently, the driving of the ricirculating document handler 1 and the driving of the copying unit 41 are controlled relative to each other by the microcomputer (CPU) 91.

To the CPU 21 of the RDH 1 are connected a sensor S1, motors 14–16, and other input/output devices, etc. via interfaces 24, 25, and these input/output devices are controlled as a whole according to a program pre-written in a ROM 22. A RAM 23 contains a memory area for this control data, and memory areas MA1 and MA2 are assigned to counters X and Y, respectively.

The CPU 21 receives operation data for a print switch 98 and input of the completion signal of the copy operation, from the CPU 91 controlling the copying unit 41, and based on the timing of input of these signals, determines a prescribed timing for processing. Also, the CPU 21 increments by 1 the value of the counter Y assigned to the memory area MA2 of the RAM 23 for each input of a copy completion signal from the CPU 91 of the copying unit 41. It also increments by 1 the value of the counter X assigned to the memory area MA1 of the RAM 23 for each feedthrough cycle at the time of jam handling.

(Document feed control during normal operation)

Figure 4:
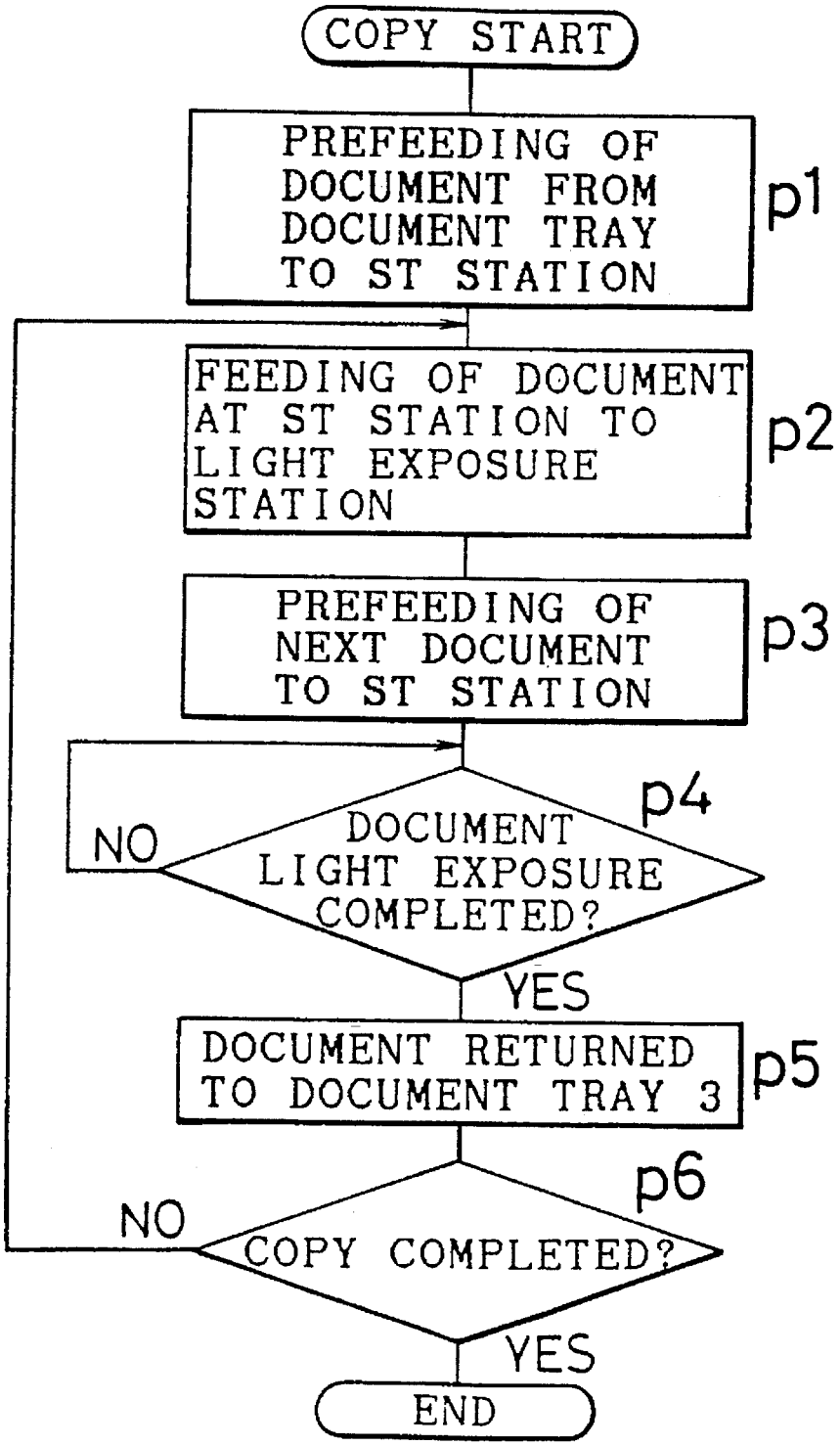
FIG. 4 is a flow chart for document feed control during normal operation of an RDH in the case of single-sided documents.
Figure 5:
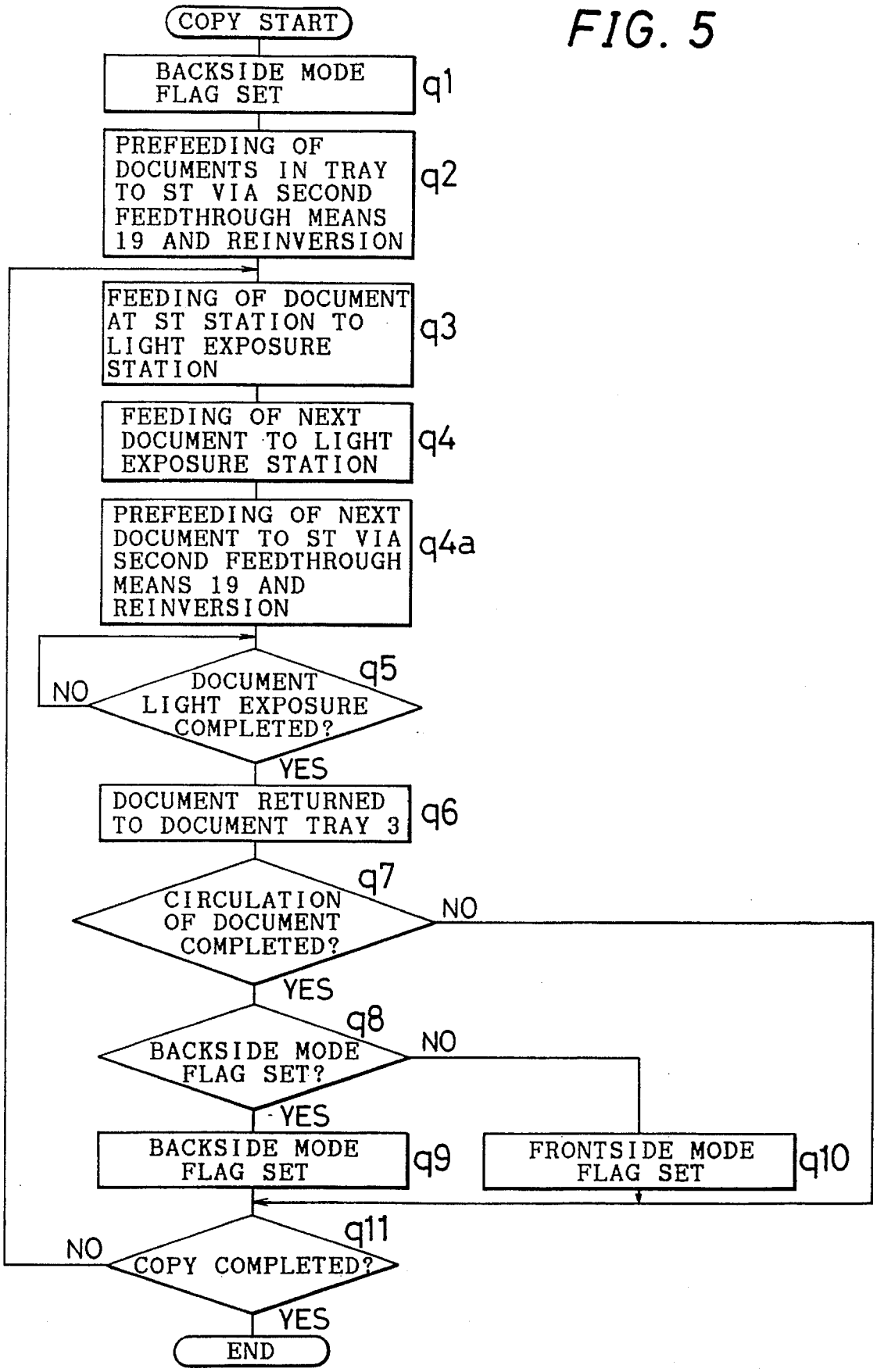
FIG. 5 is a flow chart for document feed control during normal operation of an RDH in the case of duplex copying of double-sided documents.
Figure 6:
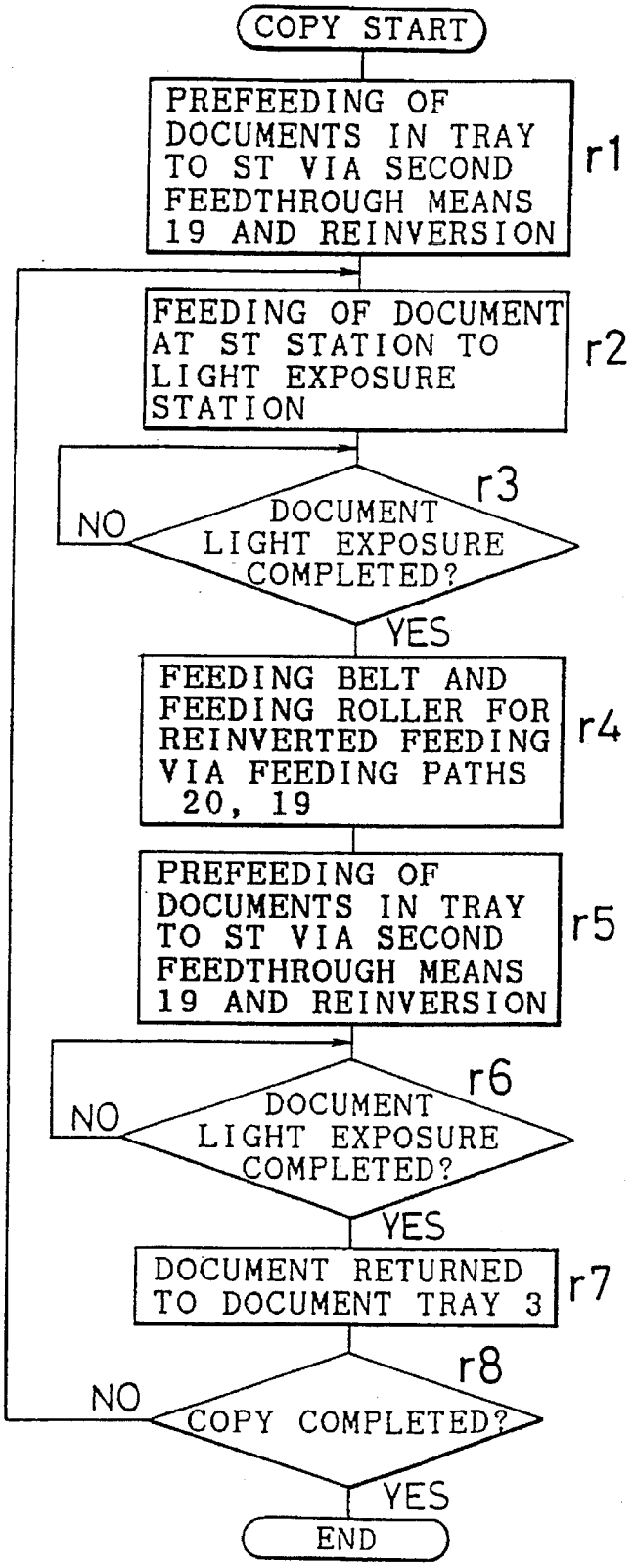
FIG. 6 is a flow chart for document feed control during normal operation of an RDH in the case of simplex copying of double-sided documents.

FIG. 4 is a flow chart for document feed control in the mode for simplex copying of single-sided documents, FIG. 5 is a flow chart for document feed control in the mode for duplex copying of double-sided documents, and FIG. 6 is a flow chart for document feed control in the copy mode for simplex copying of double-sided documents.

Here, the difference in document feeding between simplex copying of single-sided documents and duplex copying of single-sided documents is only that in the case of duplex copying of single-sided documents, the operating step for feedthrough of documents not exposed to light is placed intermittently after light exposure of the documents, and there is no difference in the basic document feeding paths. In particular, in the case of duplex copying the documents are circulated twice for the duplex copying, with the front and back sides alternating for their first circulation and their second circulation. The explanation of this type of document feeding is omitted since it has no direct connection with the subject matter of the invention. Consequently, the single-sided document feeding mode described hereunder refers to the document feeding mode for simplex copying of single-sided documents.

The feeding operation in the mode for copying from single-sided documents will first be explained using the flow chart in FIG. 4. When copying starts, the first page document (the document at the bottom) begins to be supplied from the document tray 3. The document is prefed until its top edge reaches the standby position (hereunder abbreviated to ST position) (step p1). Next, after the prefed document at the ST position is supplied to the light exposure station, the next successive document is prefed to the ST position in order to shorten the supply time (steps p2 and p3). Also, the controller waits for completion of the light exposure of the document fed to the light exposure station, and then ejects the document to the document tray 3 while determining whether the copying process has been completed (step p6), and if the copying process has not been completed it returns to the document light exposure step (step p2), and steps p4→p5→p6 are repeated. That is, steps p2 through p6 are repeated until completion of the copying process.

The document feeding operation in the mode for duplex copying of double-sided documents will now be explained using the flow chart in FIG. 5. First, when the copying process is started by the print switch, the back side mode flag for determining whether the document is to receive light exposure at the front or back is initialized, the first page document (the document at the bottom) is supplied from the document tray 3 and inverted in the first feeding path 7, passed through the second feeding path 19 for reinversion, and then prefed to the ST position (steps q1 and q2).

After the prefed document at the ST position is supplied to the light exposure station, the next document is prefed to the ST position in the same manner as explained before, in order to shorten the supply time (steps q3 and q4). Also, the controller waits for completion of the light exposure of the document fed to the light exposure station, and then ejects the document to the document tray 3 while determining whether or not that document is the last document of the cycle (steps q5, q6 and q7). If that document is the last document of the cycle, it decides whether the back side mode flag is set or initialized, initializing the flag if it is set and setting the flag if it is initialized (steps q8, q9 and q10). After this, it determines whether or not the copying process has been completed, and returns to step q2 for light exposure of the next document if the copying process has not been completed (step q11). Steps q3 through q11 are repeated until completion of the copying process.

The document feeding operation in the copy mode for simplex copying of double-sided documents will now be explained using the flow chart in FIG. 6. First, when the copying process is started, the first page document is taken from the document tray 3 and inverted at the first feeding path 7, and passes through the second feeding path 19 to be reinverted and prefed to the ST position (step r1). Next, after the prefed document at the ST position has been supplied to the light exposure station, the controller waits for completion of light exposure of the back side of the document supplied to the light exposure station (steps r2 and r3). After completion of the light exposure of the back side, the feeding belt 10 and feeding roller 8 are rotated in reverse for light exposure on the front side of the document, and then the document is passed through the feeding paths 20, 19, inverted once again and supplied to the exposing station. The next successive document is then prefed to the ST position in the same manner as in step r1 (steps r4 and r5). Also, the controller waits for completion of the light exposure of the document fed to the light exposure station, and then ejects the document to the document tray 3 while determining whether or not the copying process has been completed, returning to step r2 for light exposure of the next document if the copying process has not been completed (steps r6, r7 and r8). Steps r2 through r8 are repeated until completion of the copying process.

(Operation for initialization of documents in the case of trouble at the copying unit)

The document initialization operation for the resumption of copying according to the invention will now be explained using the flow charts in FIGS. 7 through 12.

In the case of troubles such as paper jams, paper depletion or toner depletion occurring at the copying unit, if the documents are left in the feeding roller 8 they become curled, thus lowering the quality of the documents and becoming a cause of further document jams. For this reason, the document feeding is control led so as to feed through the subsequent documents and return them to their original stacked state.

The document initialization operation in the mode for simplex copying (and likewise for duplex copying) of single-sided documents will first be explained using the flow chart in FIG. 7.

Figure 7:
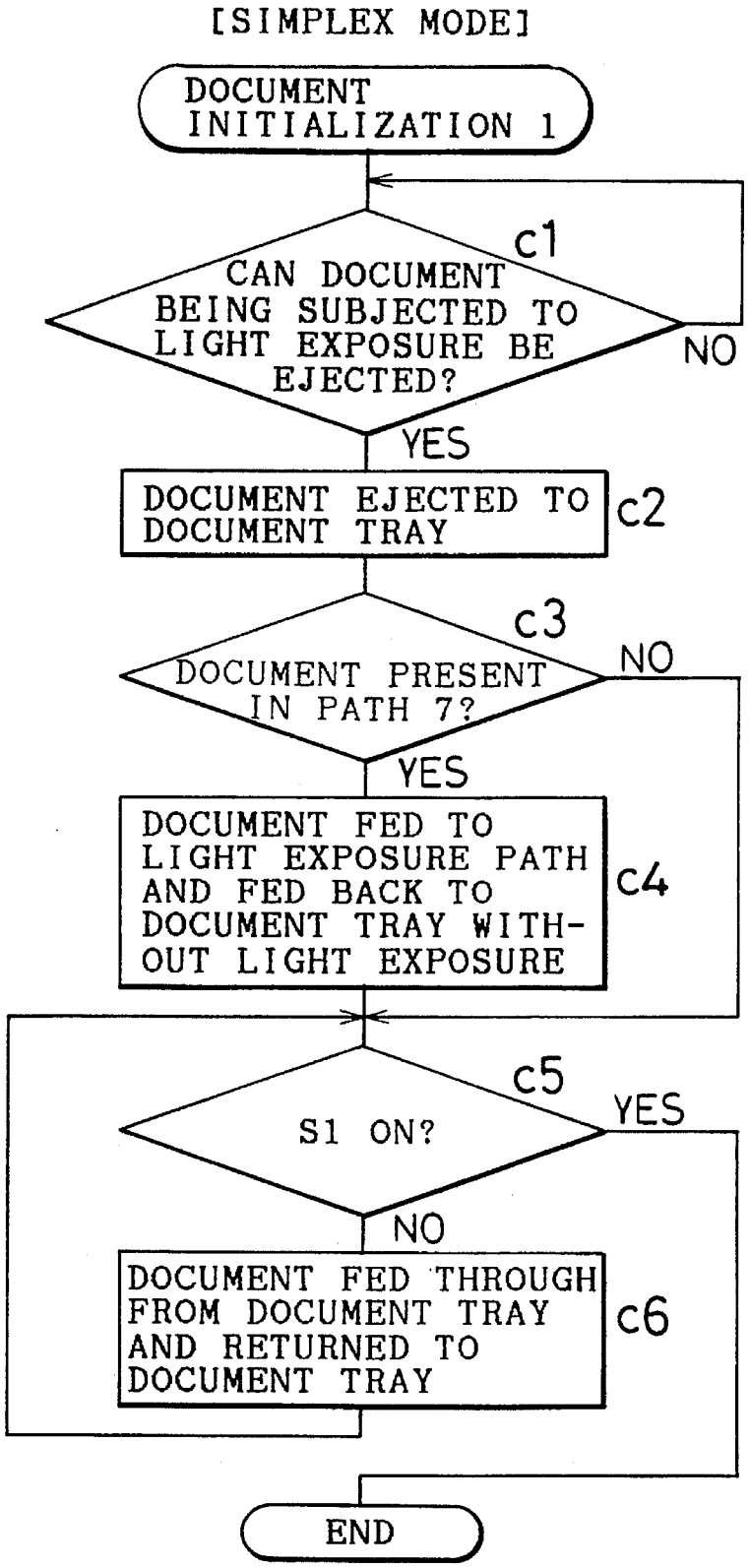
FIG. 7 is a flow chart for explanation of the operation for initialization of documents in the copy mode for single-sided documents according to the invention.

In the case of troubles such as paper jams, paper depletion or toner depletion occurring at the copying unit 41, initialization begins from the step indicated as "document initialization 1" in FIG. 7. First, it is checked whether or not the document at the light exposure station can be ejected. For example, if there is no paper in the paper supply cassette of the copying unit, an "out of paper" signal is generated. At this time, if the paper onto which the light exposure image is to be transferred has already been fed through the paper supply path at the copying unit, light exposure is possible on the document at the light exposure station, and the document is ejected after completion of the light exposure. However, if a trouble signal is generated at a timing which requires repositioning of the document, including cases where the paper supplied for the document at the light exposure station has caused a jam, the document must be ejected for synchronized refeeding with the paper. This judgment on whether the document has been ejected or not and adjustment of the timing are carried out in step c1. Also, after the document at the light exposure station has been ejected to the document tray 3, it is checked whether or not there is a document in the first feeding path 7 (steps c2 and c3).

If there is a document there, then the document is fed to the document tray 3 via the light exposure station (step c4), after which step c5 is performed to control feeding of the subsequent documents. Here it is checked whether the cycle detecting sensor S1 is on, feedthrough (circulative feeding without light exposure) of the documents is carried out until one cycle of the documents is detected by the sensor, and when all of the documents have been returned to the document tray 3 the initialization operation is suspended (step c5 to c2). In other words, since document feeding of single-sided documents always returns the documents to the document tray 3 in the originally stacked state, the documents may be simply circulatively fed without inversion, in the event of occurrence of trouble at the copying unit.

The document initialization operation in the copy mode for duplex copying of double-sided documents will now be explained with reference to the flow charts in FIGS. 8 and 9.

Figure 8:
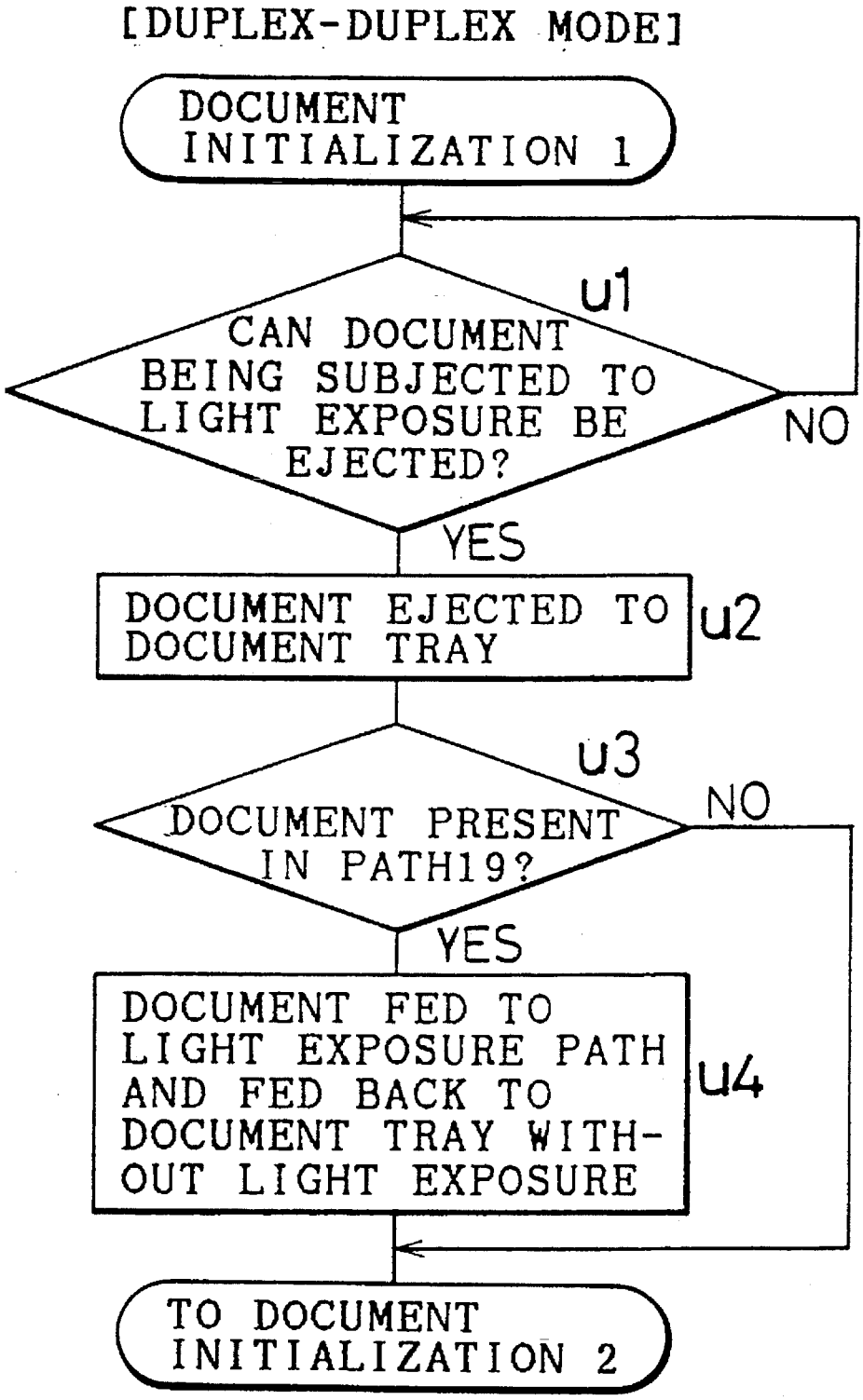
FIG. 8 is a flow chart for explanation of the operation for initialization of documents in the copy mode for duplex copying of double-sided documents according to the invention.

In the case of troubles occurring at the copying unit 1, beginning with the step indicated as "document initialization 1" in FIG. 8, it is determined whether or not the document at the light exposure station can be ejected (step u1). Here, as in FIG. 7, in cases where it can, step u2 is immediately performed, while in cases where it cannot, after exposure at the prescribed timing, the document at the light exposure station is ejected to the document tray 3 in the step u2.

Figure 9:
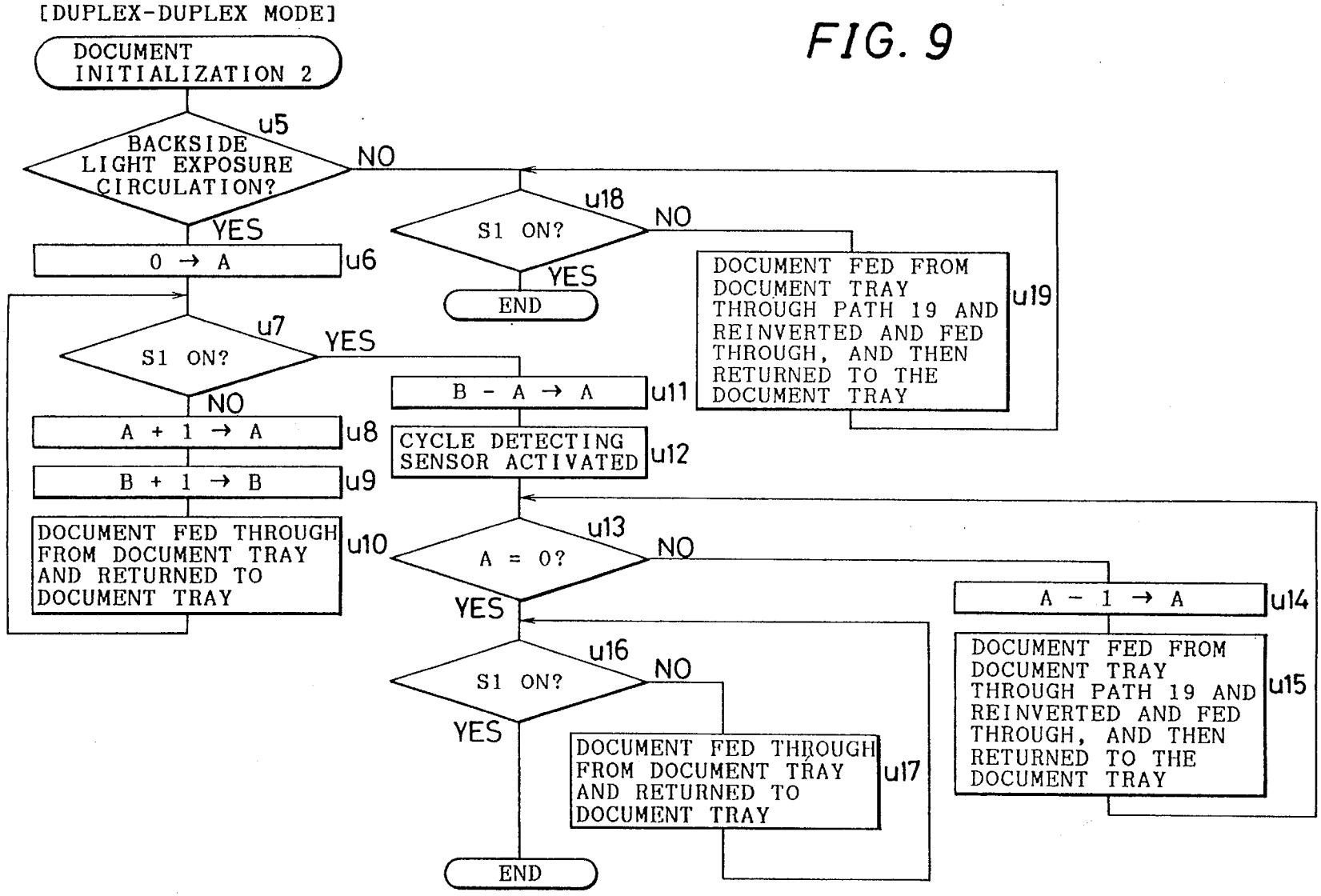
FIG. 9 is a flow chart continuing the explanation of the operation in FIG. 8.

Also, it is checked whether there is a document in the second feeding path 19 (step u3), and if there is a document then it is fed back to the document tray 3 via the light exposure station (step u4), and the flow proceeds to the "document initialization 2" step in FIG. 9.

In FIG. 9, the light exposure mode for the present circulation is checked (step u5), and in the case of back side light exposure circulation the counter A, which counts the number of times documents have been fed in single-sided document mode, is cleared (step u6). Also, it is checked whether the cycle detecting sensor S1 is on (step u7), and the counters A and B (counters which are incremented by 1 for each document fed and are cleared after one cycle, storing the total number of documents upon one cycle thereof) are incremented by 1 until one cycle of the documents has been detected by the sensor, after which the documents are fed through under feed control in single-sided document mode, and this operation circulatively feeds the documents in the document tray 3 (steps u7→step u8→step u9→step u10→step u7).

When one cycle of the documents has been detected by the cycle detecting sensor S1 in step u7 described above, the value of counter A which stores the number of times the documents have been fed under document feed control in the single-sided document mode, is subtracted from the value of counter B which stores the total number of documents, and the result of the subtraction is restored in counter A (steps u7 through u11). The value of counter A at this time indicates the number of documents which have been fed in the mode for duplex copying of double-sided documents.

Furthermore, for detection of one cycle of the documents again after the final document has been restored to the document tray 3, the cycle detecting sensor S1 is moved onto the top of the documents (step u12). After this step, the value in counter A is decremented by 1 for each sheet fed until the value in counter A is "0", while the documents are fed through without light exposure, under document feed control in the copy mode for duplex copying of double-sided documents (steps u13 through u15). When the value in counter A becomes "0", there are no more documents to be inverted. That is, at that time the odd pages of the double-sided documents (the fronts when the documents are stacked) are all kept in the document tray 3 facing upward.

Here, starting with the next document, it is again checked whether the cycle detecting sensor S1 is on, and the documents are circulated through under document feed control in the copy mode for single-sided documents, until the sensor detects one cycle of the documents, upon which the initialization of the documents (restoration to the initial stacked state of the documents) is complete (steps u16 to u17).

On the other hand, in cases where the circulation is in light exposure mode for front side light exposure when initialization of the documents is required, it is checked whether the cycle detecting sensor S1 is on (step u5) while the documents are fed through under document feed control in the copy mode for duplex copying of double-sided documents, until the sensor detects one cycle of the documents, upon which the initialization of the documents is complete (steps u18 to u19). In this manner, when documents are fed through without light exposure in the event of trouble occurring at the copying unit end during circulative feeding of double-sided documents, the inverted feeding path is used only for the minimum number of documents, and thus the initialization operation is quickened, for a considerable effect of time reduction.

Figure 10:
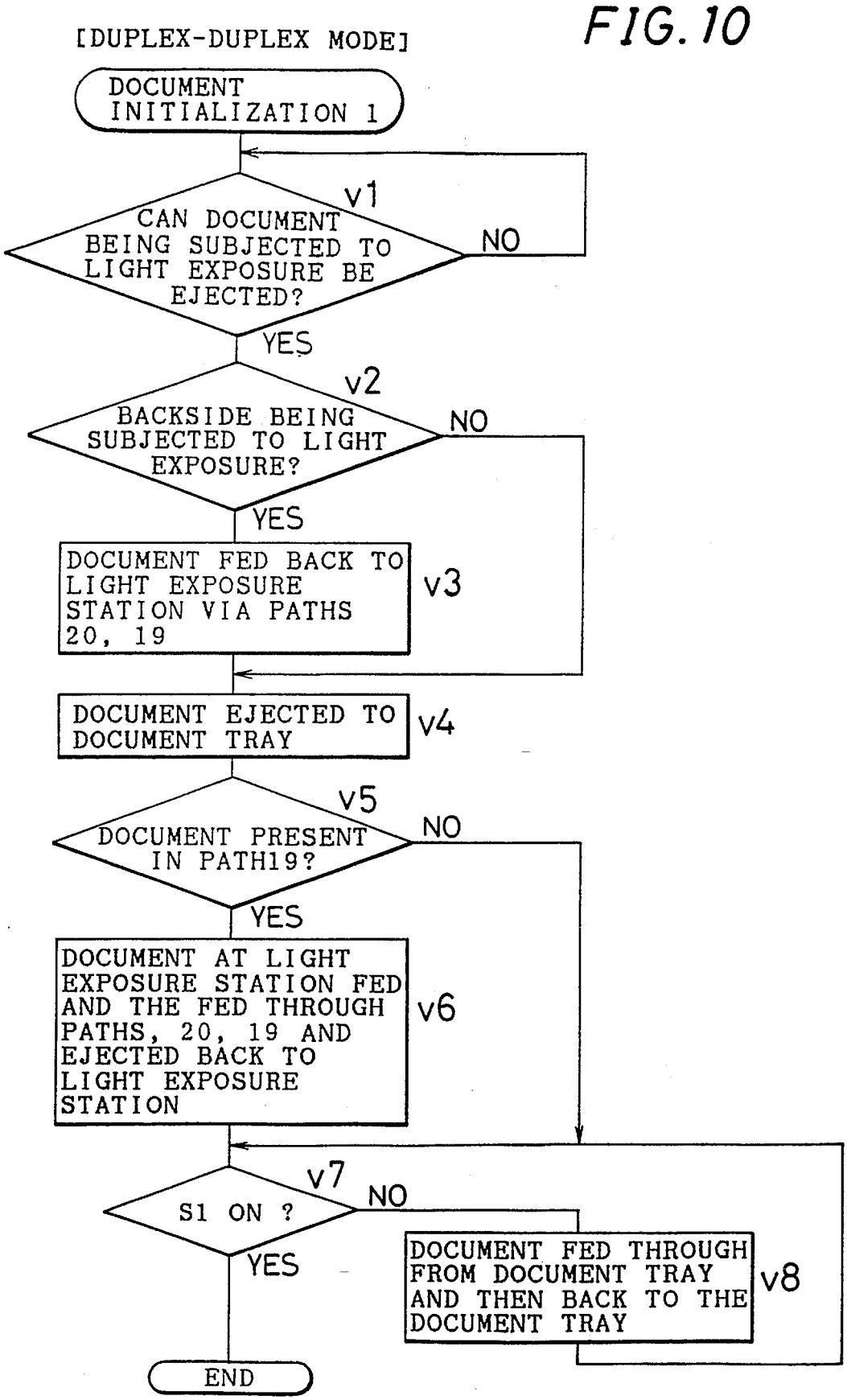
FIG. 10 is a flow chart for explanation of the operation for initialization of documents in the copy mode for simplex copying of double-sided documents according to the invention.

The document initialization operation in the copy mode for simplex copying of double-sided documents will now be explained with reference to the flow chart in FIG. 10. In the case of troubles occurring at the copying unit 1, the control operation begins with the step indicated as "document initialization 1" in FIG. 10. First, it is determined whether or not the document at the light exposure station can be ejected (step v1), and in cases where it can step v2 is immediately performed, while in cases where it cannot, the ejection timing is adjusted in the same manner as in FIG. 7.

The mode for light exposure of the documents is then checked (step v2). In the case of back side light exposure, since the document will be inverted if ejected as is, the feeding roller 8 and feeding belt 10 are rotated in reverse and the document is passed through the feeding paths 20 and 19 and resupplied to the light exposure station, by which it is reinverted (step v3). At this time, in the case of back side light exposure, since it is necessary to reinvert the document using the same feeding paths for the next front side light exposure, there are no documents in the feeding paths 19 and 20 because no documents have been prefed. Furthermore, after the document at the light exposure station has been ejected to the document tray 3 (step v4), it is checked whether a document is present in the second feeding path 19 (step v5). In cases where a document is present, since it is the document on temporary standby for the next back side light exposure, after being supplied to the light exposure station it is passed again through the feeding paths 20 and 19 to be reinverted and then supplied to the light exposure station, and then immediately ejected to the document tray 3 without copying (step v6).

After this step, step v7 is performed, the documents are fed through under document feed control in the copy mode for single-sided documents, until the cycle detecting sensor S1 detects one cycle of the documents, and all of the documents are returned to the document tray 3, upon which the initialization operation is complete (steps v7 to v8).

In this manner, even in the mode for simplex copying of double-sided documents, the inverted feeding path is used only for light exposure and prefeeding of the documents, since there is no need for all of the documents to pass through the inverted feeding path, and thus it is possible to reduce the time required for restoration (initialization) of the documents to their initial stacked state in the document tray 3.

The above description is for document feed control according to the invention, for initialization of documents in the event of trouble occurring at the copying unit end. Thus, since the documents are set in their initial stacked state in the document tray 3, they do not curl and thus a cause of further document feed jams, etc. is eliminated. However, in this state, the copywork cannot be resumed after the trouble is cleared at the copying unit end. Since the copywork is resumed in a different manner for each copy mode, the document feed control for resuming copy in each mode will be explained below. This document feeding may also be carried out in a shortened time.

(Document feed control for resuming copywork after document initialization)

Figure 11:
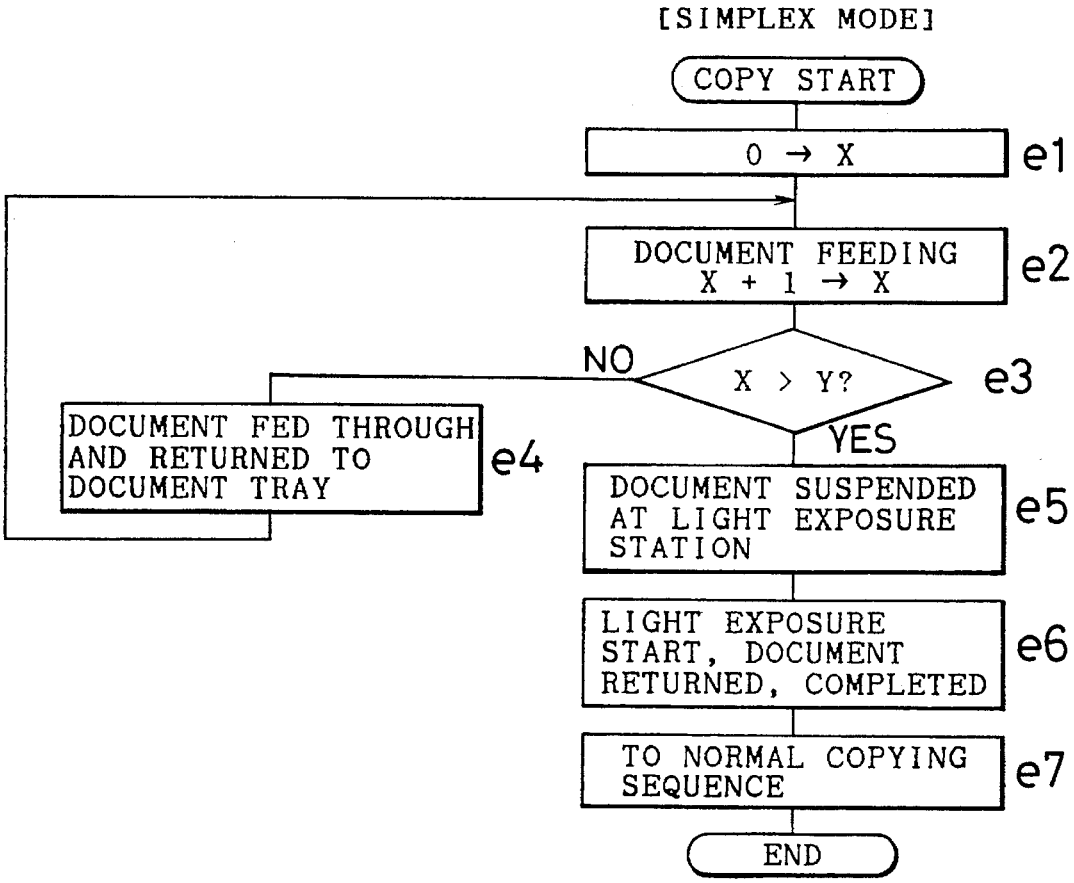
FIG. 11 is a flow chart for explanation of the restoration procedure for restarting copying after trouble has been cleared, in the copy mode for copying of single-sided documents.
Figure 12:
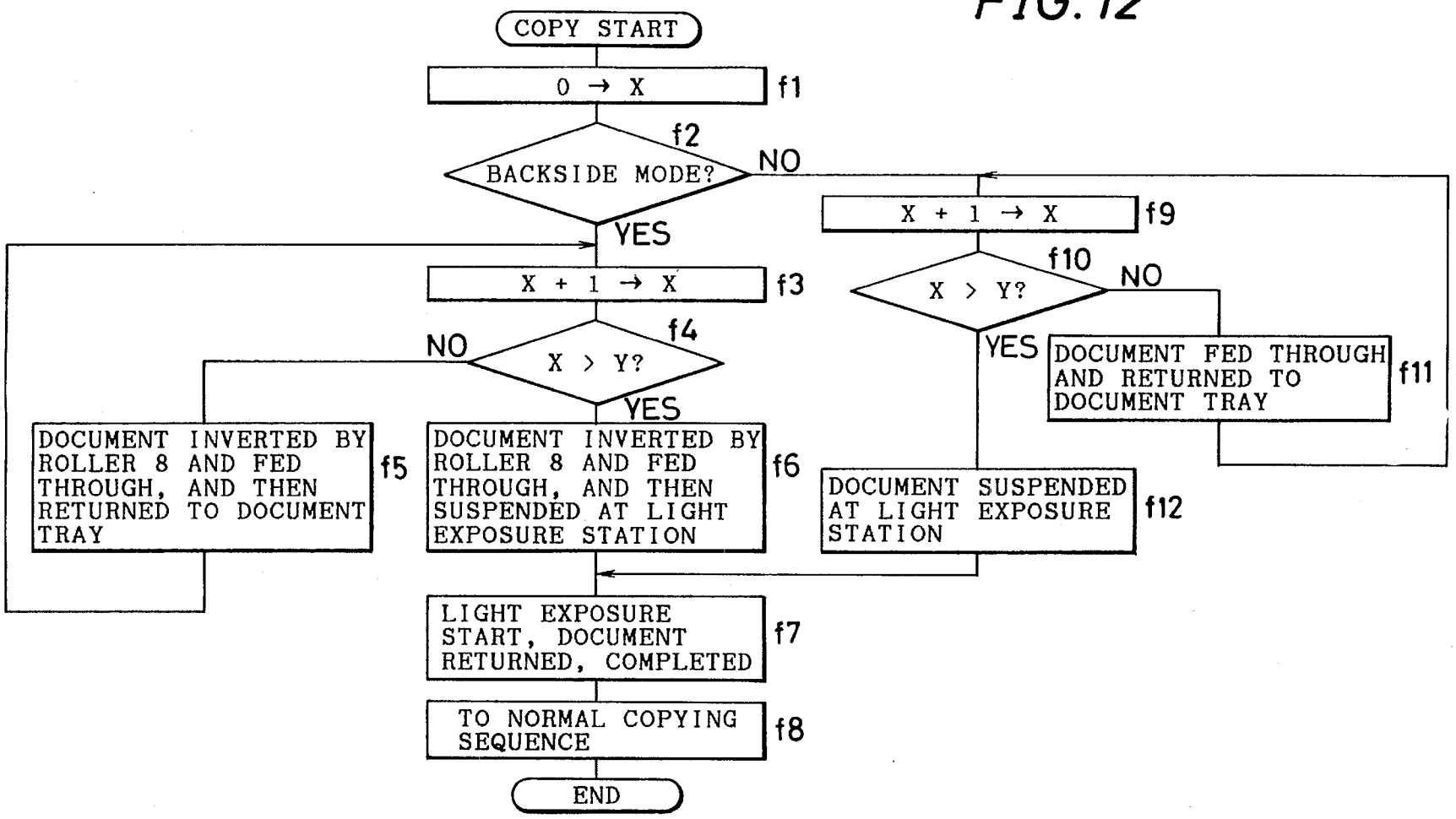
FIG. 12 is a flow chart for explanation of restoration procedures for restarting copying after trouble has been cleared, in the copy mode for duplex copying of double-sided documents.
Figure 13:
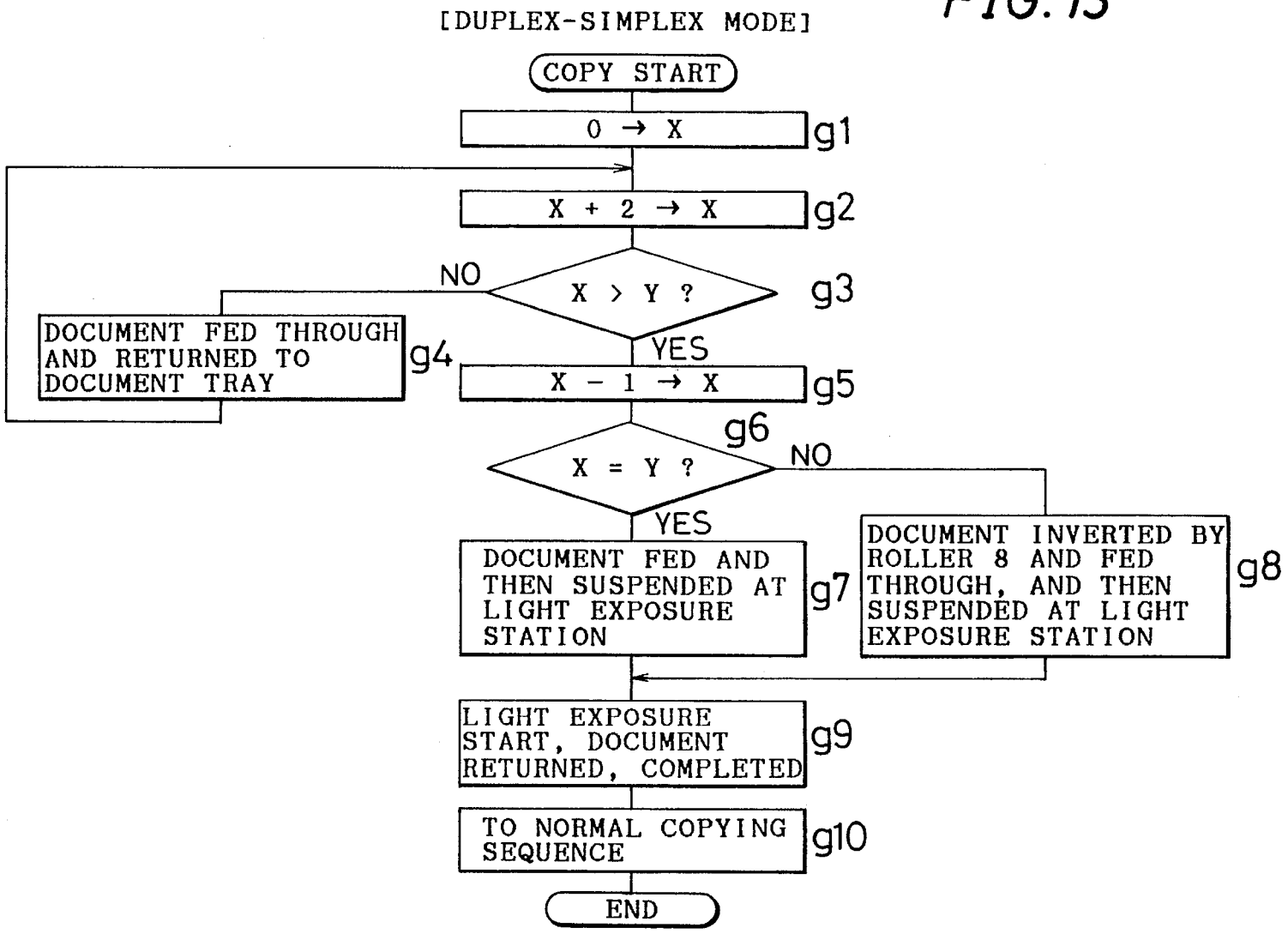
FIG. 13 is a flow chart for explanation of restoration procedures for restarting copying after trouble has been cleared, in the copy mode for simplex copying of double-sided documents.

FIGS. 11 through 13 are flow charts for this control, FIG. 11 being a flow chart for the copy mode for single-sided documents (simplex or duplex copying mode), FIG. 12 being a flow chart for the copy mode for duplex copying of double-sided documents, and FIG. 13 being a flow chart for the copy mode for simplex copying of double-sided documents, and they correspond to feed control with the normal operation in FIGS. 4 and 6 explained earlier.

The mode for copying of single-sided documents will first be explained using the flow chart in FIG. 11. When the copying unit 1 is working normally, and the copying is completed normally by the copying unit, the number of pages ejected to the ejection tray 76 is counted at a counter Y (which is cleared when one cycle of the copy paper is ejected). Therefore, it records the state of copying prior to the trouble at the copying unit. Separately, there is provided a counter X which counts the number of document pages fed through when the trouble is resolved, and it is incremented by 1 for each initialized document which is fed through.

Here, the counter X is cleared upon resuming the copying after the trouble at the copying unit has been resolved (step e1). The counter X is incremented by 1 for each document supplied, and the documents are fed through (in simplex mode without light exposure on the documents) until the value of the counter X exceeds that of the counter Y (steps e2→e3→e4→e2). Also, light exposure is resumed at the moment the value of the counter X exceeds that of the counter Y, thus restoring the normal copy sequence (steps e5→e6→e7).

The mode for duplex copying of double-sided documents will now be explained with reference to the flow chart in FIG. 12. In this case, there is provided counter Y which, when the copying unit is working normally, is incremented by 1 for each sheet of paper on which a proper image has been formed and ejected to the ejection tray 76, or for each page fed to the duplex tray 77 (and it is cleared when one cycle of copy paper is ejected, or loaded into the duplex tray 77), and there is also provided a flag which distinguishes between the copy mode wherein the documents are sent to the duplex tray 77, i.e. the mode for copying the back sides of the documents (backside mode) and the copy mode wherein the documents are supplied from the duplex tray 77, i.e. the mode for copying the front sides of the documents (frontside mode), as well as a counter X for the feedthrough of the documents. The flag which determines the backside or frontside mode is recorded during the copywork of the copying unit, and when trouble occurs, its value prior to the trouble is recorded. That is, as explained for steps q1 and q8 through q10 in FIG. 5, the flag switches automatically between set throughout the backside mode and initialized throughout the frontside mode.

The counter X is cleared in step f1 when copying is resumed after the trouble at the copying unit 1 has been resolved. Also, the mode flag is checked, and in the case of the backside mode (the mode in which documents are sent to the duplex tray 77), the counter X is incremented by 1, the documents are inverted and reinverted via the feeding paths 7 and 19, and are fed to the exposing station (steps f2, f3, f4 and f5). Each time this document feeding is performed, the counter X is incremented by 1, and the feed through of the documents is repeated until the value of the counter X exceeds that of the counter Y. That is, the documents are fed in duplex copying mode for double-sided documents without light exposure.

Light exposure is resumed at the moment the value of the counter X exceeds that of the counter Y when checked in step f4, thus returning the copy sequence to normal (steps f6, f7 and f8). Conversely, in cases where the mode flag indicates frontside mode (the mode for supplying documents from the duplex tray 77), the documents are circulatively fed by the same feeding method as for single-sided documents, without reinverting them in the feeding path 19. First, the counter X is incremented by 1 for each document fed (step f9), and the documents are fed through (fed in single-sided mode without light exposure) until the value of the counter X exceeds that of the counter Y (steps f2→f9→f10→f11→f9). The light exposure is resumed at the moment the value of the counter X exceeds that of the counter Y when checked in step f4, thus returning the copy sequence to normal (steps f12→f7→f8).

Consequently, in cases where the copying was in frontside mode when trouble occurred at the copying unit, since the feeding of documents is not through an inverted feeding path, rapid job restoration to light exposure of the documents at the time of the trouble may be effected.

Job restoration in the case of the mode for simplex copying of double-sided documents after initialization of the documents will now be explained with reference to the flow chart in FIG. 13. In this case, there are provided a counter Y which is incremented by 1 each time a sheet of paper on which an image has been formed during proper working of the the copying unit 1 before the trouble is ejected to the ejection tray 76 (which is cleared when one cycle of the copy paper has been ejected) and a counter X which is incremented by 2 for each feedthrough.

Here, the counter X is cleared when copying is resumed (step g1) after resolution of the trouble at the copying unit 41. Also, the counter X is incremented by 2 for each document supplied, the values of the counters X and Y are compared, and the documents are fed through in single-sided mode without light exposure until the value of the counter X exceeds that of the counter Y (steps g2→g3→g4→g2). At the moment the value of the counter X exceeds that of the counter Y, the counter X is incremented by only 1 (step g5), and the values of the counters X and Y are compared again. In cases where they are equal, since the next exposure mode is for the front side of the document (odd-numbered page), the document is fed in single-sided mode, and light exposure is resumed after it stops at the light exposure station, thus returning the copy sequence to normal (steps g5→g6→g7→g9→g10).

On the other hand, in cases where the values of the counters X and Y are not equal at step g6, since the next exposure mode is for the back side of the document, the document is fed in double-sided document mode (document circulation feeding mode for reinverting documents in the feeding paths 7, 19 and feeding them to the light exposure station), and light exposure is resumed after it stops at the light exposure station, thus returning the copy sequence to normal (steps g8→g9→g10).

Thus, in the case of double-sided documents, it has been common that when both sides thereof are exposed to the light exposure station, the documents must be invertedly fed, inevitably requiring their inverted feeding for initialization of the documents; however, since according to the invention the inverted feeding is used only when absolutely necessary, the time until copying is resumed may be greatly reduced.

Figure 14:
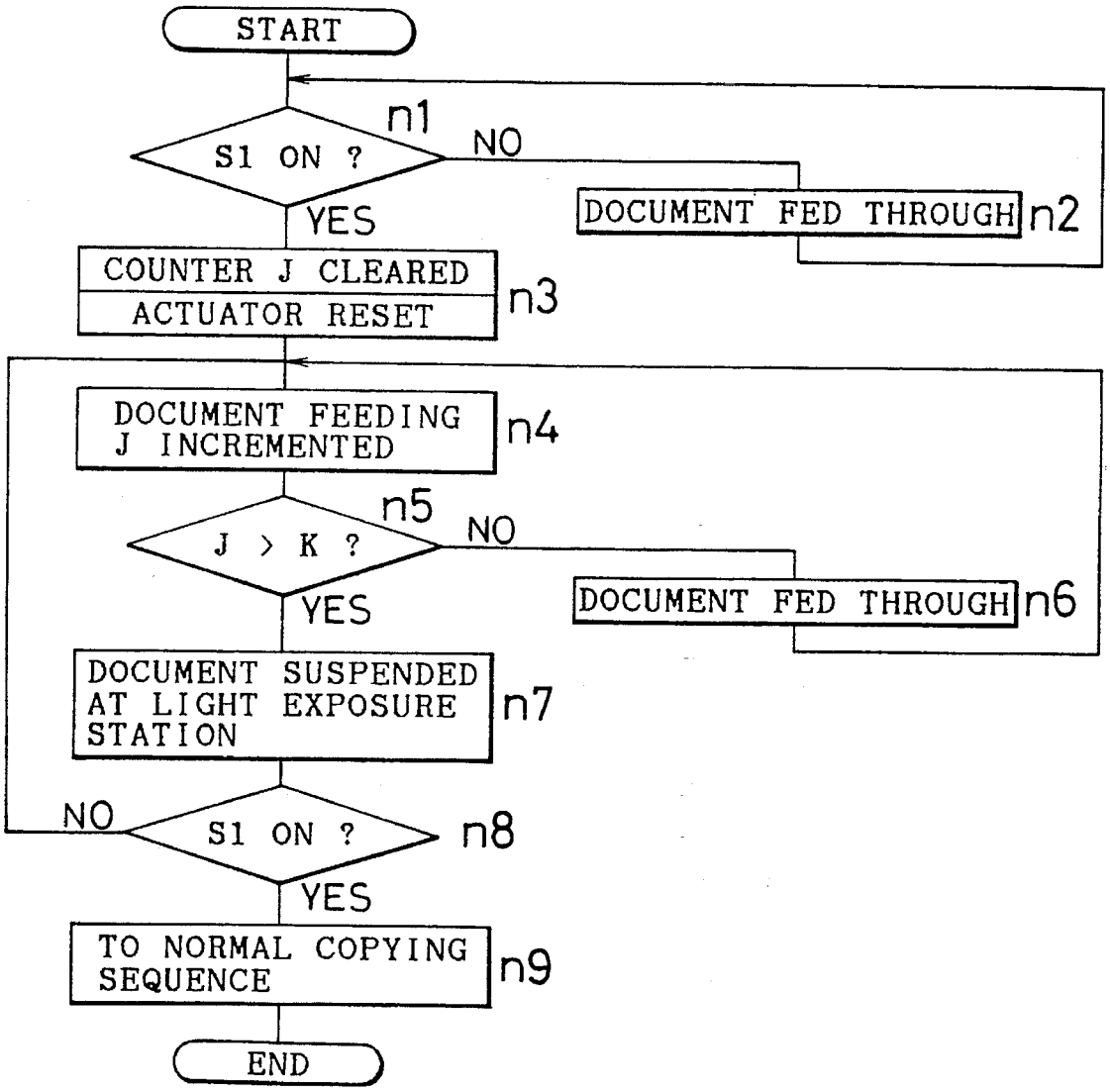
FIG. 14 shows procedures for restoration of a jam in the RDH controller, in the single-sided copy mode.

FIG. 14 is a flow chart corresponding to FIG. 11 above, showing a portion of the processing procedure for the controller of the RDH. When a document jam occurs in any of the document feeding paths, the CFU 21 of the RDH 1 detects the occurrence of the jam by the delay of the detection signal of a document detecting sensor (not shown), and outputs a jam signal to the CPU 91 of the copying unit 41 while also halting the motors 14–16. The CFU 91 of the copying unit 41 halt the operation upon receipt of the inputted jam signal, and displays on a display the fact that a jam has occurred. The operator, recognizing from this display that a jam has occurred at the RDH 1, performs jam clearing by removing the jammed document from the document feeding path.

The single or multiple documents removed from the document feeding path are placed on top of the documents stacked in the document tray 3, in the same initial stacking state in the document tray 3, and the print switch 98 of the copying unit 41 is pressed. The CPU 21 of the RDH 1 waits for the input of the activating signal of the print switch 98 from the CPU 91 after occurrence of the jam, and when the activating signal of the print switch 98 is inputted, the documents in the document tray 3 are fed through the document feeding path until the sensor S1 is turned on (n1, n2). The handling at n1 and n2 corresponds to the first feedthrough means according to the invention.

Next, the counter J corresponding to the counter X in FIG. 11, assigned to the memory area MA1 of the RAM 23 is cleared (n3), and the value of the counter J is incremented for each sheet fed through, while the documents in the document tray are fed through the document feeding path until the value of the counter J matches the value of the counter K (n4 to n6). This procedure from n4 to n6 corresponds to the second feedthrough means according to the invention. When the total value of the counter J exceeds the total value of the counter K, which corresponds to the counter Y in FIG. 11, the document at the bottom of the document tray 3 is fed to the copyboard 42, and copy processing is carried out for this document (n7). The feeding of the documents including copy processing is continued until the sensor S1 is turned on again (n8), and when the S1 sensor is turned on the copy sequence returns to normal (n9). The steps n7 and n8 correspond to the processing feeding means according to the invention.

Figure 15A:
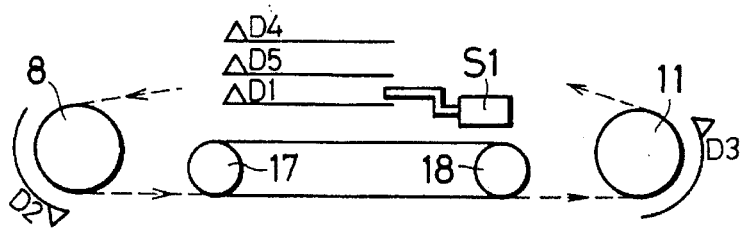
FIGS. 15A–15E show the state of documents during the procedures for restoration of a jam in the RDH in the single-sided copy mode.
Figure 15B:
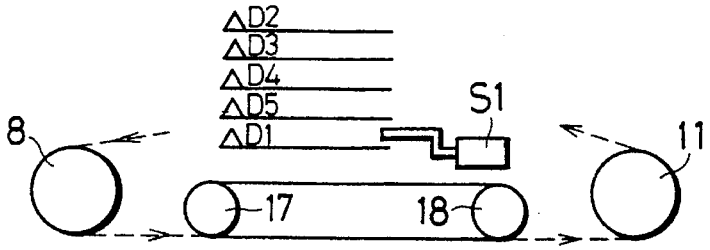

By the processing described above, in the case of simplex copying of five single-sided documents D1 to D5 as shown in FIG. 15A, when a jam occurs immediately after copying of the third document D3 has been completed, with the second and third documents D2 and D3 located in the document feeding path, the operator places the documents D2 and D3 which have been suspended in the document feeding path, on the fourth document D4 on top of the stack in the document tray 3, in their stacking order as prior to the beginning of the copying process (see FIG. 15B).

Figure 15C:
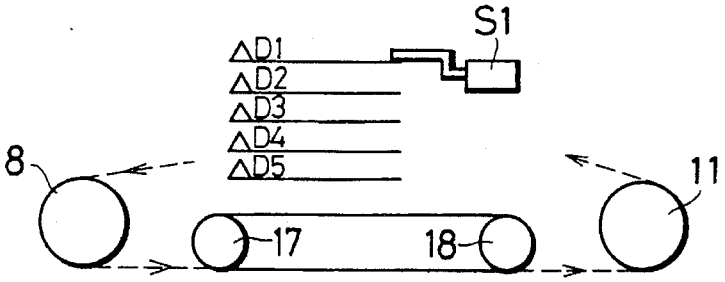

Then, when the print switch 98 of the copying unit 41 is pressed, the first document D1 is fed through by the first feedthrough means (FIG. 14, n1 and n2) and returned onto the uppermost sheet in the document tray. At the same time, the actuator 2 of the sensor S1 is initialized (meaning that it is moved to a position touching the top surface of the document D1 located on top of the stack in the document tray), and the five documents D1 through D5 are restored to their initial stacked state (see FIG. 15C).

Figure 15D:
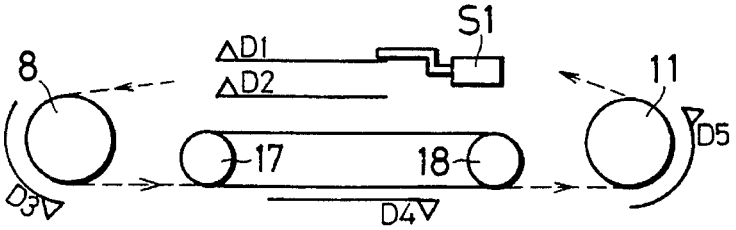
Figure 15E:
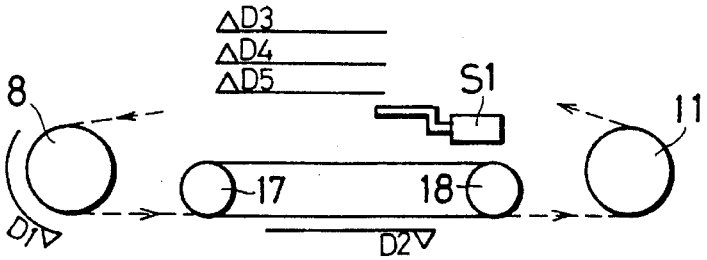

Next, the documents D3 through D5 are fed through by the second feedthrough means (FIG. 14, n4 to n6), beginning with the document D5 at the bottom (see FIG. 15D), and the copy sequence is returned to normal after the copying process has been performed by the processing feeding means (FIG. 14, n8 and n9) for the document which caused the jam, in the state shown in FIG. 15E).

Figure 16:
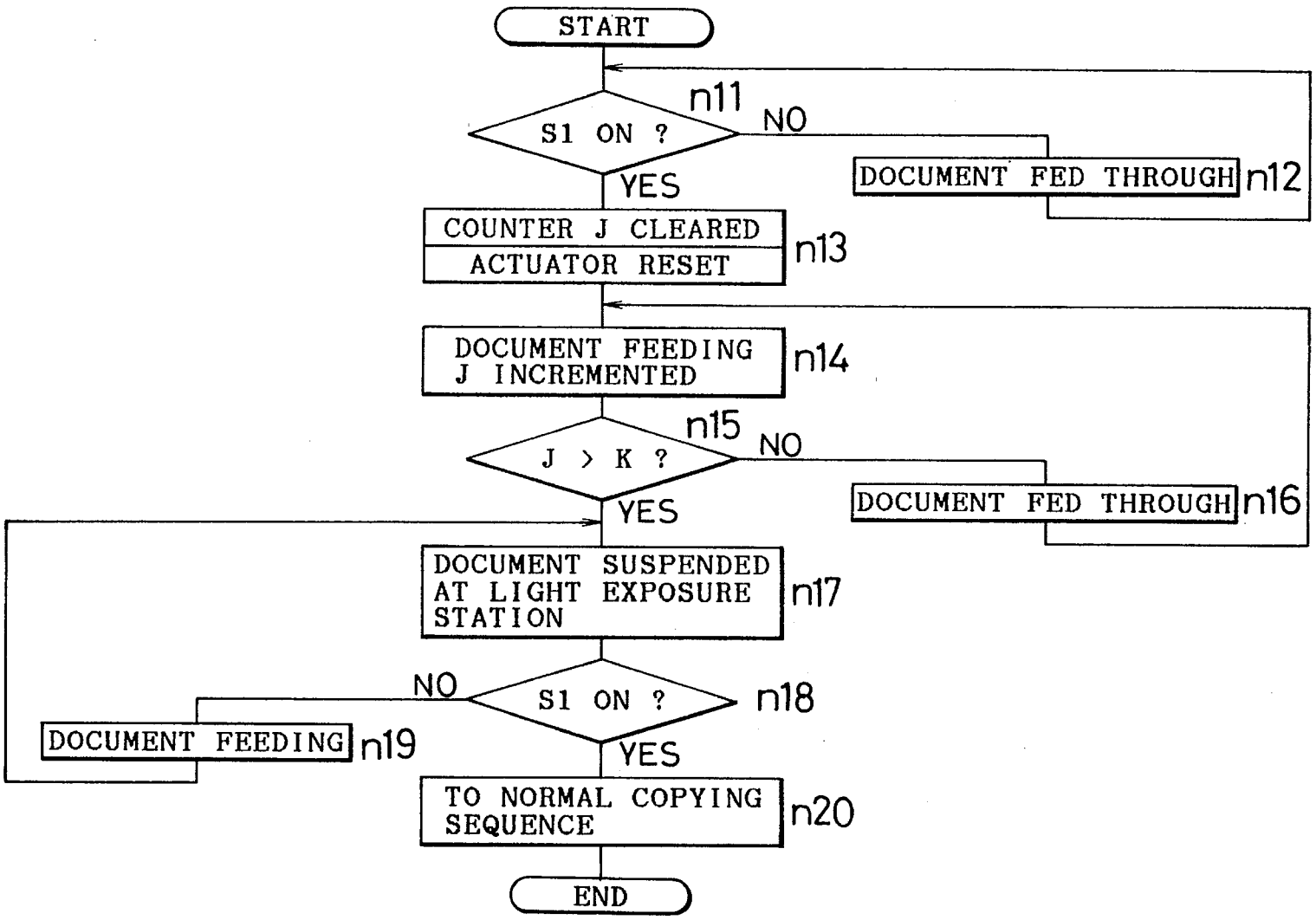
FIG. 16 shows procedures for restoration of a jam in the RDH controller, in the double-sided copy mode.
Figure 17A:
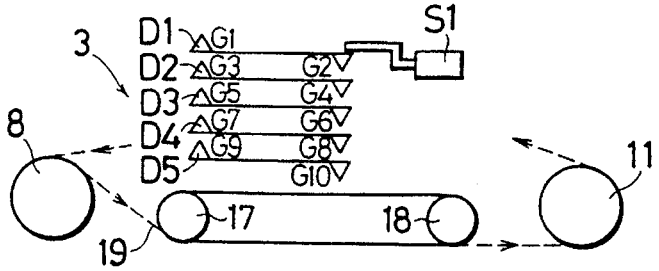
FIGS. 17A–17F show the state of documents during procedures for restoration of a jam in the RDH in the double-sided copy mode.

FIG. 16 is a flow chart for jam handling in the duplex copying mode by the controller. As mentioned earlier and shown in FIG. 17A, when five documents stacked in the document tray 3 are duplex copied, the RDH 1 circulates the five documents through the circulation path two consecutive times. The five documents are fed with their backs facing the copyboard 42, beginning with the back side G10 of the fifth document D5. At this time, each of the documents is guided from its tail end to the copyboard 42 via the inverted feeding path 19, by reverse rotation of the feeding roller 8.

Consequently, upon completion of the first cycle of the five documents, they become stacked in the document tray in their initial stacking order and with their front and back sides inverted. When the second circulative feeding of the document in this state is then effected through the inverted feeding path 19, the front side of each document is fed in order starting with the front side G9 of the fifth document D5.

Figure 17B:
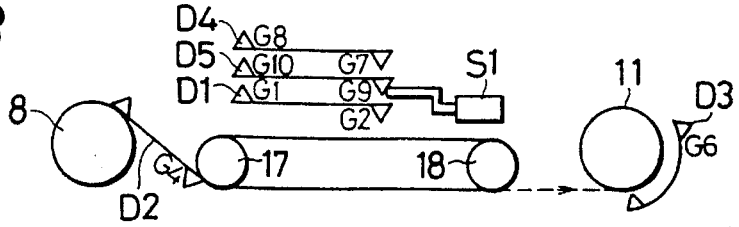
Figure 17C:
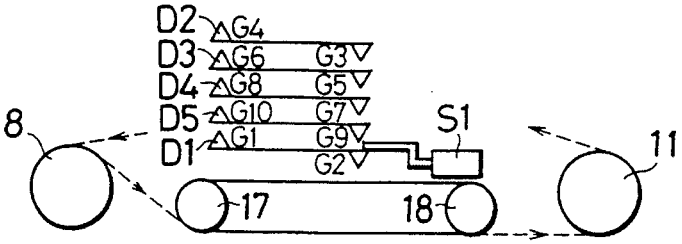

When a jam occurs with the third document D3 or the second document D2 after completion of copying of the back side G6 of the document D3 during duplex copying mode, the third document D3 and the second document D2 are suspended in the document feeding path at the tim of the jam (see FIG. 17B). At this time, the operator activates the print switch 98 after removing the two documents D2 and D3 from the document feeding path and placing them in the same orientation as the uppermost document of the stack in the document tray at that point, and in the same initial document stacking order (see FIG. 17C).

Figure 17D:
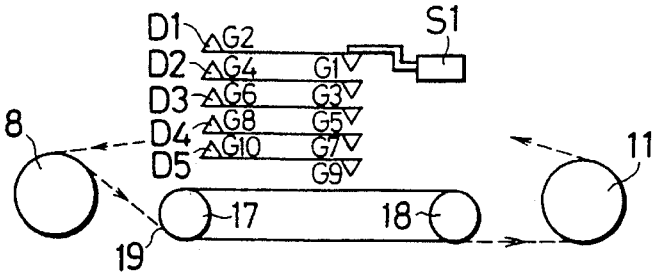

When the print switch is pressed after a jam occurring in duplex copying mode, the CPU 21 of the RDH 1 feeds through the documents stacked in the document tray via the inverted feeding path 19 until the sensor S1 is turned on (n11, n12). The steps n11 and n12 correspond to the first feedthrough means according to the invention. When the sensor S1 is turned on, the counter J is cleared and the actuator 2 of the sensor S1 is initialized (n13). Thus, the five documents D1 through D5 become stacked in the document tray in the manner shown in FIG. 17D.

Figure 17E:
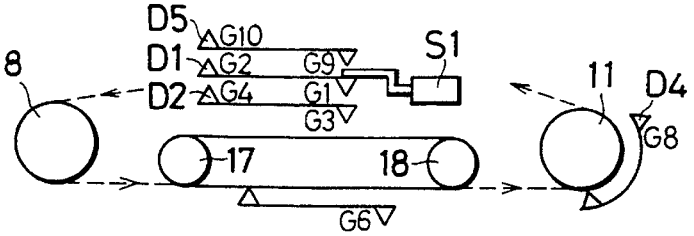
Figure 17F:
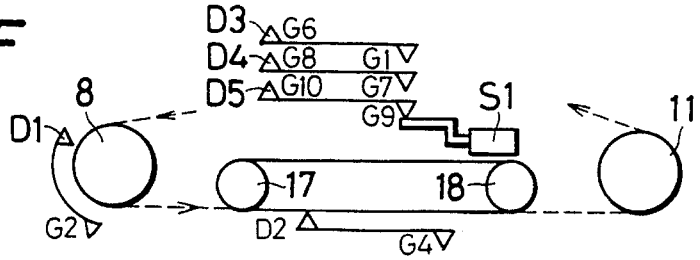

The value of the counter X is then incremented for each document fed through, while the documents in the document tray are fed through until the value of the counter J exceeds the value of the counter K (n14 to n16). This is not effected through the inverted feeding path (see FIG. 17E). The steps n14 to n16 correspond to the second feedthrough means according to the invention. Next, the documents are fed to the copyboard 42 for copying without passing through the inverted feeding path 9, until the sensor S1 is switched on again (n17 to n19) (see FIG. 17 F). The steps n17 to n19 correspond to the processing feeding means according to the invention. This process completes the copying of the back sides of all of the documents ending with the first document D1.

By the above processing, continuous proper duplex copywork is made possible with the operator needing merely to place in the document tray 3 in the prescribed orientation only the documents which were in the document feeding path at the time of the jam.

Since the order of stacking of the documents by the operators differs depending on whether the jam has occurred during simplex copying mode, during backside copying in duplex copying mode, or during frontside copying in duplex copying mode, an appropriate guide for proper stacking may be displayed on the display of the copying unit 42.

Figure 18:
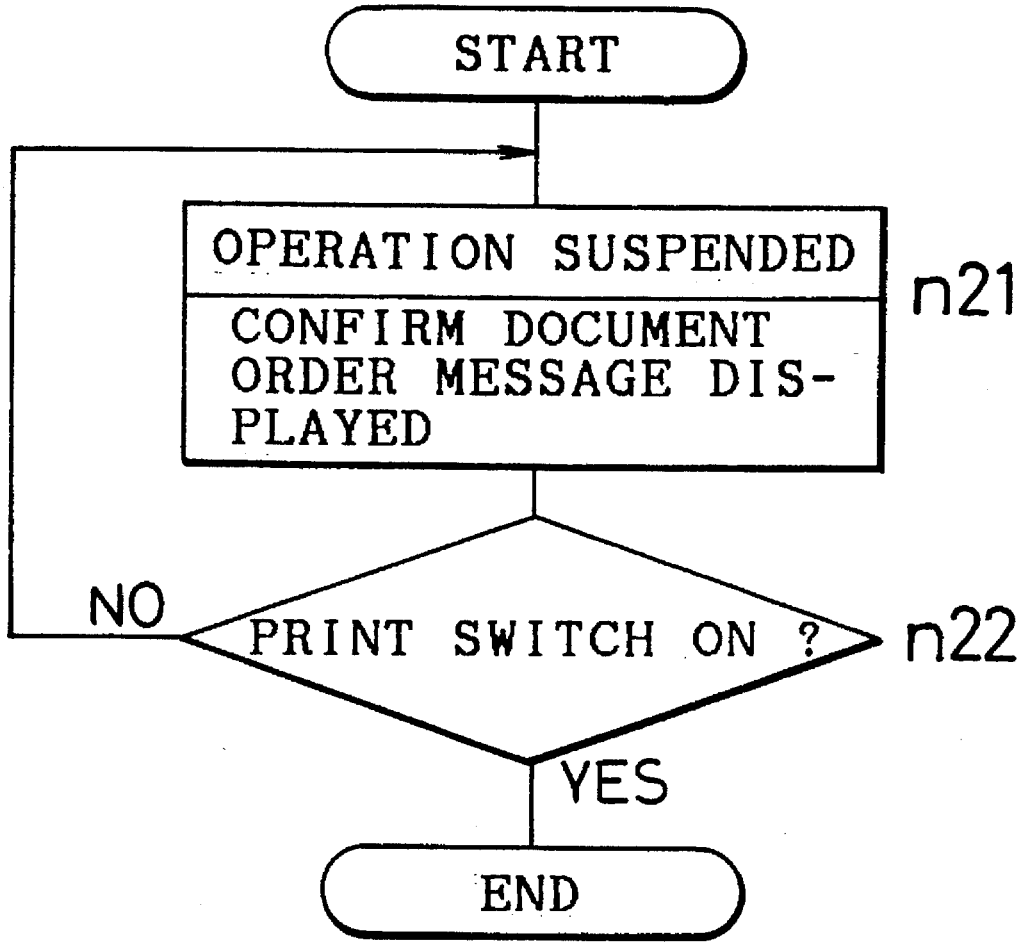
FIG. 18 is a flow chart for a portion of processing procedures of an RDH controller according to an embodiment of the invention.
Figure 19A:
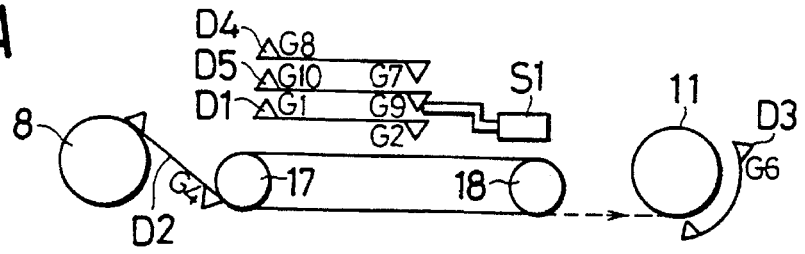
FIGS. 19A–19D show the state of documents during procedures for restoration of a jam in the RDH.
Figure 19B:
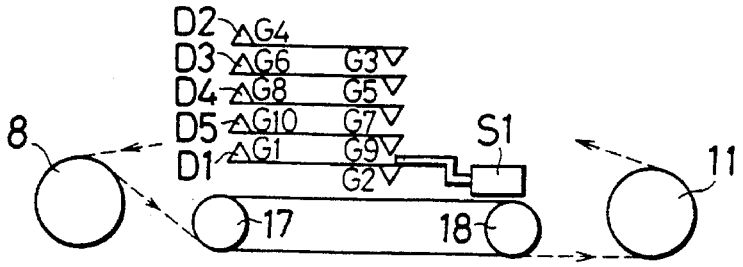
Figure 19C:
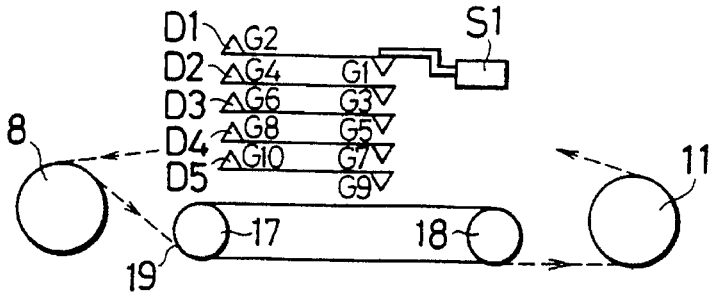
Figure 19D:
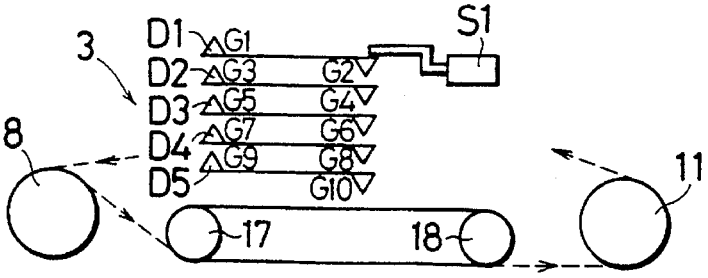

FIG. 18 is a flow chart showing a portion of the processing procedure of an embodiment of the RDH according to the invention. In the processing in FIGS. 14 and 16, activation of the print switch 98, after the operator has returned the documents in the document feeding path back to the document tray 3, automatically causes continuation of post-jam copy processing, after the prescribed feedthrough operation has been carried out, and therefore if the operator makes a mistake in the order of the documents when returning them to the document tray 3, miscopying results.

Here, according to the invention, the operator is prompted to confirm the stacking order of the documents before resuming the copy processing for after jam clearance, and the copy processing is carried out after this confirmation, thus preventing miscopying. As a result, the processing in steps n21 and n22 shown in FIG. 18 are inserted after the processing in steps n1 to n3 and steps n11 to n13 shown in FIGS. 14 and 16. Thus, a message is displayed on the display of the copying unit 41 prompting the operator to confirm the stacking order of the documents. If the print switch 98 is pressed after confirmation based on this display, then the copy processing begins from the unprocessed documents after the already copied documents have been fed through. The steps n21 and n22 correspond to the message displaying means according to the invention.

In cases where the jam has occurred during backside copying in the document feeding path in the first cycle in duplex copying mode, the message prompting the operator to confirm the stacking order of the documents may be displayed after restoration to the initial state of the documents in the document tray 3 by feedthrough of the documents, as shown in FIGS. 19A to 19D. The message may also be displayed on a display provided on the RDH 1.

Figure 20A:
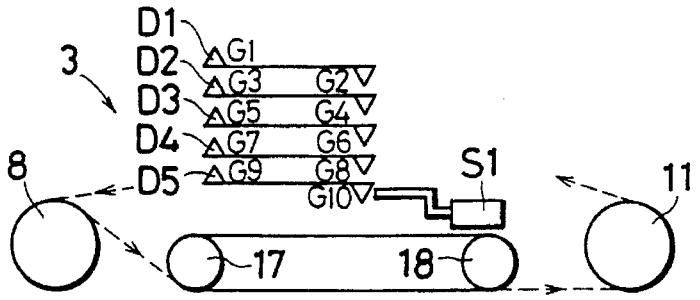
FIGS. 20A–20D show the state of documents during procedures for restoration of a jam in the RDH.
Figure 20B:
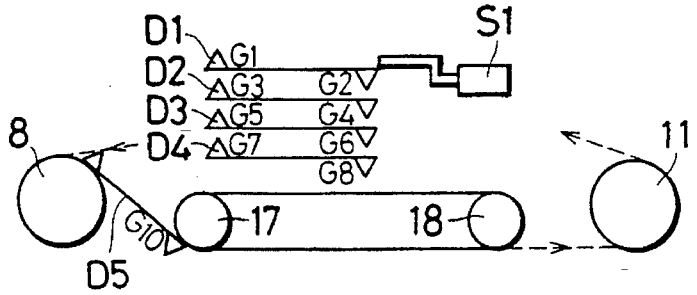
Figure 20C:
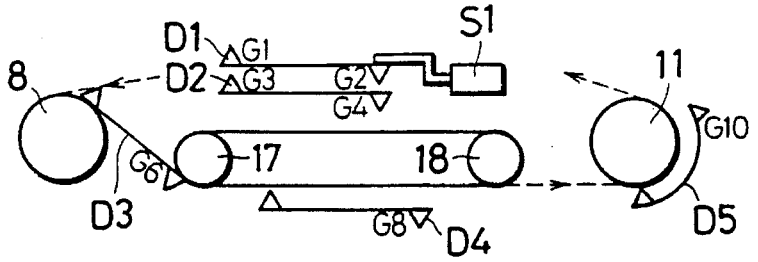
Figure 20D:
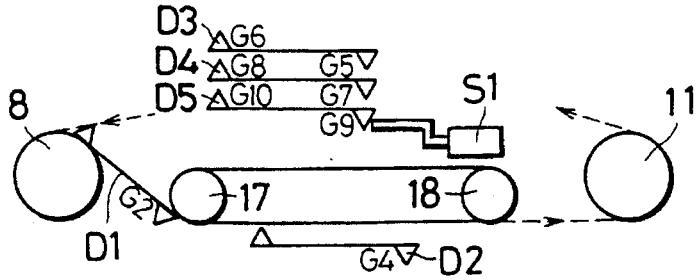

When the print switch 98 is pressed after this confirmation, the copied documents are fed through via the inverted feeding path 19 as shown in FIGS. 20A and 20B by the processing in n13 to n20 shown in FIG. 6. In addition, the unprocessed documents are delivered to the copyboard 42 via the inverted feeding path 19, for copy processing (see FIGS. 20C and 20D).

In the manner described above, copying of documents may be accurately and efficiently carried out after a jam occurs, whether in simplex copying mode or duplex copying mode.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. In an imaging apparatus provided with an automatic recirculating document handler comprising a circulative feeding path which feeds documents stored in a document tray to a light exposure station with one side of the documents facing either upward or downward and, after the documents have been read, feeds the documents back to the document tray with the one side facing in the same upward or downward direction, and an inverted feeding path which invertedly feeds the documents to expose the opposite sides of the documents to light at the light exposure station, positioned in the circulative feeding path, for forming an image corresponding to the document on paper which is appropriately fed when the circulating documents are exposed to light at the light exposure station, wherein the improvement comprises the recirculating document handler further comprising:

a cycle detecting sensor for detecting one cycle through the circulative feeding path of all the documents stored in the document tray; and initializing feed control means for feeding documents in the circulation path of the automatic recirculating document handler back to the document tray in the event of trouble occurring in the imaging apparatus, while circulatively feeding the remainder of the documents in the document tray until one cycle is detected by the cycle detecting sensor, wherein said initializing feed control means, depending on the copy mode prior to the occurrence of trouble, selects the inverted feeding path for feeding a document being circulatively fed which is to be returned to the document tray, only when the document which is fed for restoration to the initial held state should be inverted when returned to the document tray, and otherwise selects the circulative feeding path.

2. The imaging apparatus provided with a recirculating document handler according to claim 1, further comprising means for setting the copy mode for simplex copying of double-sided documents, wherein said initializing feed control means selects, based on the state of copying, whether or not the document in the circulative feeding path should be fed through the circulative feeding path via the inverted feeding path, and the documents in the document tray are fed through the circulative feeding path.

3. The imaging apparatus provided with a recirculating document handler according to claim 1, further comprising means for setting the copy mode for duplex copying of double-sided documents, wherein said the initializing feed control means selects, based on the state of copying, whether or not the document in the circulative feeding path should be fed through the circulative feeding path via the inverted feeding path, and the documents in the document tray are fed after selecting, based on the state of copying of the document, whether the copied document should be fed via the inverted feeding path.

4. In an imaging apparatus provided with an automatic recirculating document handler comprising a circulative feeding path which feeds documents stored in a document tray to a light exposure station with one side of the documents facing either upward or downward and, after the documents have been read, feeds the documents back to the document tray with the one side facing in the same upward or downward direction, and an inverted feeding path which invertedly feeds the documents to expose the opposite sides of the documents to light at the light exposure station, positioned in the circulative feeding path, for forming an image corresponding to the document on paper which is appropriately fed when the circulating documents are exposed to light at the light exposure station, wherein the improvement comprises the recirculating document handler further comprising:

a cycle detecting sensor for detecting one cycle through the circulative feeding path of all the documents stored in the document tray;

initializing feed control means for feeding documents in the circulation path of the automatic recirculating document handler back to the document tray in the event of trouble occurring in the imaging apparatus, while circulatively feeding the remainder of the documents in the document tray until one cycle is detected by the cycle detecting sensor;

storage means for storing the copy mode at the time of occurrence of trouble in the imaging apparatus and the state of copying prior to the trouble; and copy restoration control means for feeding documents in the document tray which have been initialized upon clearing of the trouble of the imaging apparatus, after determining, based on the stored information of said storage means, whether or not the document being processed at the time of the trouble should be passed through the inverted feeding path to be exposed to light at the light exposure station;

wherein said initializing feed control means, depending on the copy mode prior to the occurrence of trouble, selects the inverted feeding path for feeding the document being circulatively fed which is to be returned to the document tray, only when the document which is fed for restoration to the initial held state should be inverted when returned to the document tray, and otherwise selects the circulative feeding path.

5. A sheet-circulating feeder provided with a circulative feeding path from the bottom of a document tray via a processing station to the top of the document tray, comprising:

first feedthrough means for circulating sheets on top of the document tray through a circulative feeding path during a restoration operation after a sheet jam, to restore an original stacking order of multiple sheets on the document tray to their state prior to the beginning of their processing;

second feedthrough means for circulating processed sheets through the circulative feeding path after completion of their circulation by said first feedthrough means, without processing the sheets at a processing station; and processing feeding means for processing unprocessed sheets at the processing station after completion of their feedthrough by said second feedthrough means and feeding a remainder of the sheets through the circulative feeding path.

6. The sheet-circulating feeder according to claim 5, further comprising cycle detecting sensor means for detecting a completion of one cycle of the multiple sheets stacked in the document tray through the circulative feeding path, and processed sheet counting means for counting the number of sheets which have been processed at the processing station, wherein said first feedthrough means is means for circulating sheets on the document tray without processing the sheets at the processing station until said cycle detecting sensor means detects the completion of one cycle of all the sheets counting those processed before the occurrence of the jam, and said second feedthrough means is means for circulating only the number of the sheets in the tray counted by the processed sheet counting means after completion of circulation of the sheets by said first feedthrough means, without processing the sheets in the document tray at the processing station.

7. A sheet-circulating feeder provided with a circulative feeding path from a bottom of a document tray to a top of the document tray, via an inverting feeder which inverts the front and back ends of the sheets and a processing station which processes the sheets, comprising:

first feedthrough means for circulating the sheets in the document tray through a circulative feeding path during a restoration operation after a sheet jam, to restore the stacking order of multiple sheets in the document tray or to restore the stacking order and up/down orientation of the multiple sheets in the document tray to their state prior to initiation of processing at said processing station;

second feedthrough means for circulating the processed sheets through the circulative feeding path after completion of their circulation by said first feedthrough means, without processing the sheets at said processing station; and processing feeding means for processing the unprocessed sheets at the processing station after completion of the feedthrough by said second feedthrough means and feeding a remainder of the sheets through the circulative feeding path.

8. The sheet-circulating feeder according to claim 7, further comprising cycle detecting means for detecting a completion of one cycle of the multiple sheets stacked in the document tray, through the circulative feeding path, and processed sheet counting means for counting the number of sheets which have been processed at the processing station, wherein said first feedthrough means is means for circulating the sheets in the document tray without processing the sheets at the processing station, until the cycle detecting means detects the completion of one cycle of all the sheets counting those processed before the occurrence of the jam, said second feedthrough means is means for circulating only the number of sheets in the tray counted by said processed sheet counting means after completion of circulation of the sheets by said first feedthrough means, without inverting the front and back ends of the sheets in the document tray at the inverting feeder or processing the sheets at the processing station, and said processing feeding means is means for processing the unprocessed the sheets at the processing station without inverting the front and back ends at the inverting feeder, and feeding a remainder of the sheets through the circulative feeding path, until one additional cycle of all the sheets including those circulated by the second feedthrough means is detected.

9. The sheet-circulating feeder according to claim 7, further comprising cycle detecting means for detecting one cycle of all of the multiple sheets stacked in the document tray through said circulative feeding means and said processed sheet counting means for counting the number of sheets which have been processed at the processing station, wherein said first feedthrough means is means for circulating the sheets in the document tray without processing the sheets at the processing station, until the cycle detecting means detects two cycles of all the sheets including those processed before the occurrence of the jam, said second feedthrough means is means for circulating only the number of the sheets in the tray counted by said processed sheet counting means after completion of circulation of the sheets by said first feedthrough means, without processing the sheets at the processing station, and said processing feeding means is means for processing the unprocessed sheets at the processing station and feeding the sheets through the circulative feeding path, until the cycle detection means detects one additional cycle of all the sheets including those circulated by said second feedthrough means.

10. The sheet-circulating feeder according to any of claims 5 to 9, further comprising message displaying means for displaying a message which prompts confirmation of the stacking state of the sheets in the document tray after the sheets have been circulated by said first feedthrough means, and delaying means for delaying the initiation of engagement of said second feedthrough means until input of the confirmation.

11. The sheet-circulating feeder according to claim 10, wherein said message displaying means displays its message upon detection of the prescribed number of cycles of sheets by said cycle detecting means during the restoration operation after the occurrence of a jam.

* * * * *